US006775487B2

(12) United States Patent
Kakeshita

(10) Patent No.: US 6,775,487 B2
(45) Date of Patent: Aug. 10, 2004

(54) IMAGE FORMING APPARATUS, UNIT DETACHABLY ATTACHABLE TO IMAGE FORMING APPARATUS AND DEVELOPER REMAINING AMOUNT DISPLAYING SYSTEM

(75) Inventor: Tomomi Kakeshita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/871,644

(22) Filed: Jun. 4, 2001

(65) Prior Publication Data

US 2002/0037173 A1 Mar. 28, 2002

(30) Foreign Application Priority Data

Jun. 5, 2000 (JP) ..... 2000-168228
May 31, 2001 (JP) ..... 2001-165868

(51) Int. Cl.[7] ..... G03G 15/08
(52) U.S. Cl. ..... 399/27; 399/29
(58) Field of Search ..... 399/27, 29, 30, 399/44

(56) References Cited

U.S. PATENT DOCUMENTS 4,707,748 A 11/1987 Ohtsuka et al. ..... 358/298
5,142,332 A * 8/1992 Osawa et al. ..... 399/44
5,923,917 A * 7/1999 Sakurai et al. ..... 399/27
5,946,522 A * 8/1999 Inami ..... 399/27
6,459,361 B1 10/2002 Kajimura ..... 340/7.56

FOREIGN PATENT DOCUMENTS

JP 61-185761 * 8/1986
JP 62-63961 * 3/1987
JP 63-212956 * 9/1988
JP 5-188752 * 7/1993

* cited by examiner

*Primary Examiner*—Fred L. Braun
(74) *Attorney, Agent, or Firm*—Fitzpatrick, Cella, Harper & Scinto

(57) ABSTRACT

The present invention provides an image forming apparatus and method for determining a remaining amount of developer contained in a cartridge including a developer container for containing developer, a developer amount detecting device for detecting an amount of the developer contained in the developer container, and a calculating device for calculating a display level of a remaining amount of the developer. At least the developer container is detachably mountable to a main body of an image forming apparatus as a unit. The calculating device calculates the display level on the basis of a detection amount of the developer amount detecting device and predetermined information regarding a developer remaining amount in the container upon generation of a white void image.

44 Claims, 27 Drawing Sheets

IMAGE FORMING APPARATUS, UNIT DETACHABLY ATTACHABLE TO IMAGE FORMING APPARATUS AND DEVELOPER REMAINING AMOUNT DISPLAYING SYSTEM

BACKGROUND OF THE INVENTION

1. Field of the Invention

The present invention relates to an image forming apparatus such as a copying machine, a printer and the like, a unit detachably attachable to such an image forming apparatus, and a developer remaining amount displaying system, and more particularly, it relates to an image forming apparatus capable of displaying a remaining amount of developer correctly, a unit detachably attachable to such an image forming apparatus, and a developer remaining amount displaying system.

2. Related Background Art

In conventional electrophotographic image forming apparatuses such as electrophotographic copying machines, laser beam printers and the like, a latent image is formed by illuminating light corresponding to image information onto an electrophotographic photosensitive member, and the latent image is visualized as a developer image by supplying developer to the latent image from developing means, and an image is formed on a recording medium by transferring the developer image from the photosensitive member to the recording medium. A developer containing container as a developer containing portion is connected to the developing means, and the developer is consumed as the image is formed.

In such an image forming apparatus, for the purpose of facilitating exchanging consumed parts such as the electrophotographic photosensitive member and the developer and maintenance, there has been proposed a process cartridge in which an electrophotographic photosensitive member and process means (such as developing means, electrifying means and/or cleaning means) and a developer containing container and a waste developer container are integrally incorporated as a cartridge unit which is detachably attachable to a main body of the image forming apparatus. According to such a process cartridge, since the maintenance of the apparatus can be performed by an operator himself without any expert, operability can be enhanced remarkably. Thus, the process cartridge has widely be used in the electrophotographic image forming apparatus.

Further, for example, in a color image forming apparatus having a plurality of color developing means, when consumed degrees of respective developing means are different, the respective developing means and the corresponding developer containing containers may be incorporated as respective color developing cartridges which are independently detachably attachable to the main body of the image forming apparatus.

In an image forming apparatus of a cartridge type, for example, when the developer is exhausted, by exchanging the cartridge with a new one by the operator, image formation can be performed again. To this end, the image forming apparatus may have means for detecting consumption of the developer and for notifying the result to the operator.

In order to always know the amount of developer (to be used for image formation) remaining in the cartridge, the cartridge or the main body of the image forming apparatus is provided with developer remaining amount detecting means capable of detecting a developer remaining amount level.

Particularly, there is a technique in which the convenience to the operator is further enhanced not only by notifying consumption (exhaustion) of the developer to the operator but also by successively detecting and notifying the remaining amount of developer. Among image forming apparatuses including such a technique, there is an image forming apparatus in which the percentage of the developer remaining amount regarding non-used developer is calculated and the calculated amount is successively noticed to the user or a "no developer" condition indicating the fact that the developer is decreased to the extent that image formation having a predetermined image quality cannot be achieved is displayed, thereby informing the user of an insufficient developer remaining amount before a poor image is generated.

As means for detecting the developer remaining amount, there is a system in which at least a pair of input and output electrodes are provided and the developer amount is detected by measuring electrostatic capacity between these electrodes. As one of such developer remaining amount detecting means of electrostatic measurement type, there is a plate-antenna type.

Regarding the plate-antenna type, for example, in a cartridge utilizing a developing system for developing a latent image formed on an electrophotographic photosensitive member by applying AC bias to a developer carrying member of developing means, a metal plate as an electrode is provided in a confronting relationship to the developer carrying member or plural metal plates are provided at other plural locations, and the developer amount is detected by utilizing a property that electrostatic capacity between the metal plate and the developer carrying member or between the metal plates is varied with the amount of developer (insulative toner) therebetween.

That is to say, if the space between the metal plate and the developer carrying member or between the metal plates is filled with the developer, the electrostatic capacity therebetween becomes great, and, as the developer is decreased, air in the space Is gradually increased to decrease the electrostatic capacity. Accordingly, so long as a relationship between the electrostatic capacity between the metal plate and the developer carrying member or between the metal plates and the developer amount is previously sought, the developer amount can be detected by measuring the electrostatic capacity.

The measurement of the electrostatic capacity is effected by measuring electrical current flowing through the metal plate when the AC bias is applied to the developer carrying member or by measuring electrical current flowing through one of the plural metal plates when the AC bias is applied to the other (electrode) of the plural metal plates. Namely, in the developer remaining amount detecting means of plate-antenna type, in many cases, the developer amount is detected during image formation in which the developing bias is being applied to the developer carrying member.

In the above-mentioned developer amount detecting means of electrostatic capacity type, a relationship between the electrostatic capacity detected by the developer remaining amount detecting means and the developer amount is previously sought, and the amount of the developer can be determined from a table or calculation based on such relationship and a detected value of the electrostatic capacity.

However, in the system for detecting the remaining amount of the developer by utilizing the electrostatic capacity, even when developer remaining amount detecting means having the same construction is used and the remaining developer amount (weight) is the same, due to dispersion in distribution of the developer along the metal plate for detecting the electrostatic capacity and/or dispersion in density of the remaining developer, it is not always possible to detect the same electrostatic capacity, and, thus a change in electrostatic capacity upon reduction of the developer may be varied or differentiated, with the result that there arises dispersion in transition of a developer remaining amount detection value detected on the basis of the electrostatic capacity.

Such dispersion in distribution and density of the developer remaining in the developer containing container is caused by fluidity of the developer and/or difference in developer amount initially loaded and/or difference in construction of the container.

If the developer amount cannot be detected correctly for the above-mentioned reasons, for example, when a developer amount is estimated to be more than the actual developer remaining amount, in spite of the fact that the developer is decreased to the extent that an image having a predetermined image quality cannot be formed, since the operator erroneously feels that the developer is still remaining, for example, a cartridge to be exchanged cannot be prepared at a proper timing, with the result that a poor image such as a white void image will be generated. On the other hand, when the developer amount is estimated to be less than the actual developer remaining amount, in spite of the fact that the developer is still remaining, the cartridge is exchanged with a new one, with the result that usable developer is discarded, thereby wasting resources.

SUMMARY OF THE INVENTION

The present invention aims to eliminate the above-mentioned conventional drawbacks, and an object of the present invention is to provide an image forming apparatus capable of displaying a remaining amount of developer correctly, a unit detachably attachable to such an image forming apparatus, and a developer remaining amount displaying system.

Another object of the present invention is to provide an image forming apparatus capable of informing exchange of a unit at a proper timing, a unit detachably attachable to such an image forming apparatus, and a developer remaining amount displaying system.

A further object of the present invention is to provide an image forming apparatus comprising a developer container for containing developer, developer amount detecting means for detecting an amount of the developer contained in the developer container, and calculating means for calculating a display level of a remaining amount of the developer, and wherein at least the developer container is detachably mountable on a main body of an image forming apparatus as a unit, and further wherein the calculating means calculates the display level on the basis of a detection amount of the developer amount detecting means and predetermined information regarding a developer remaining amount in the container upon generation of a white void image.

A still further object of the present invention is to provide a unit detachably attachable to an image forming apparatus, comprising a memory, and a developer container for containing developer, and wherein the memory stores predetermined information regarding a developer remaining amount in the container upon generation of a white void image.

A further object of the present invention is to provide a developer remaining amount displaying system comprising a first unit which is detachably attachable to a main body of an image forming apparatus and in which developer is loaded, a second unit which is detachably attachable to the main body of the image forming apparatus and in which developer more than that in the first unit is loaded and which can be mounted to the main body of the image forming apparatus in place of the first unit, and a display for displaying a remaining amount of the developer, and wherein, when the second unit is mounted to the main body of the image forming apparatus, the display displays the fact that there is no remaining amount of the developer or the fact that the unit should be changed at a stage that a detection remaining amount of developer remaining amount detecting means is greater than when the first unit is mounted.

A still further object of the present invention is to provide a developer remaining amount displaying system comprising a first unit which is detachably attachable to a main body of an image forming apparatus and in which developer is loaded and which has an agitating sheet for agitating the developer, a second unit which is detachably attachable to the main body of the image forming apparatus and which has an agitating sheet having a longer free length than the agitating sheet of the first unit and which can be mounted to the main body of the image forming apparatus in place of the first unit, and a display for displaying a remaining amount of the developer, and wherein, when the second unit is mounted to the main body of the image forming apparatus, the display displays the fact that there is no remaining amount of the developer or the fact that the unit should be changed at a stage that a detection remaining amount of developer remaining amount detecting means is greater than when the first unit is mounted.

The other objects and features of the present invention will be apparent from the following detailed explanation of the invention referring to the accompanying drawings.

DETAILED DESCRIPTION OF THE PREFERRED EMBODIMENTS

Now, an image forming apparatus, a cartridge and a remaining amount displaying system will be fully described with reference to the accompanying drawings.

First Embodiment

First of all, an embodiment of an electrophotographic image forming apparatus to which a process cartridge constituted in accordance with the present invention can be mounted will be explained with reference to FIGS. 1 and 2. In the illustrated embodiment, the electrophotographic image forming apparatus is embodied as an electrophotographic laser beam printer A serving to receive image information from a host computer and to form an image on a recording medium such as a recording paper, an OHP sheet, cloth and the like by an electrophotographic image forming process. Further, in the laser beam printer A according to the illustrated embodiment, a process cartridge B can be exchanged by dismounting and mounting, which will be fully described later.

The laser beam printer A has a drum-shaped electrophotographic photosensitive member, i.e., photosensitive drum 1. The photosensitive drum 1 is uniformly electrified by an electrifying roller 2 as electrifying means, and, then, by scan-exposing the surface of the drum with a laser beam L emitted from a laser scanner 3 in response to image information, an electrostatic latent image corresponding to the target image information is formed on the photosensitive drum 1. The electrostatic latent image is visualized as a toner image by supplying developer T from a developing apparatus C to the latent image.

Figure 1:
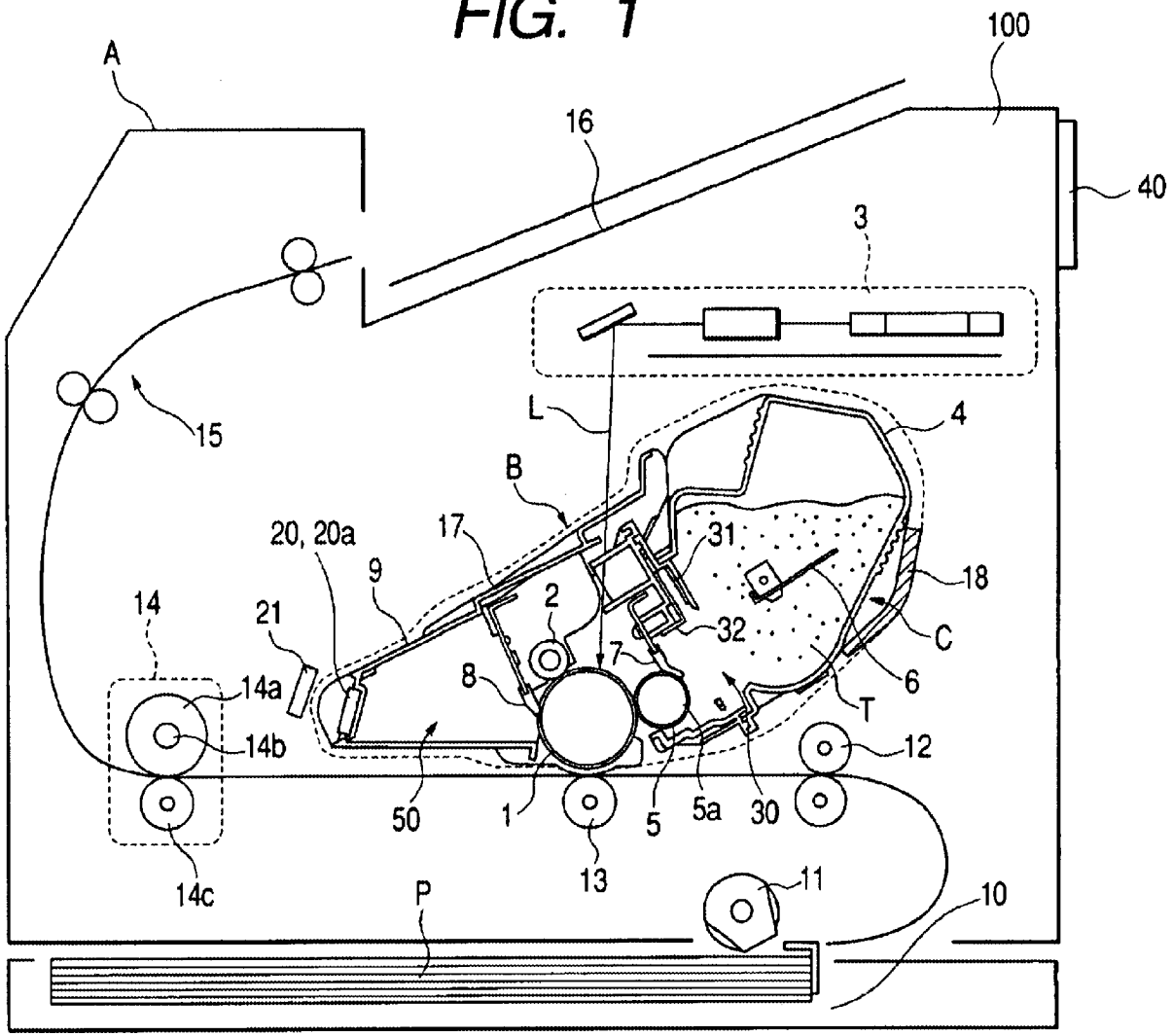
FIG. 1 is a schematic sectional view showing an image forming apparatus and a cartridge mounted on the image forming apparatus, according to an embodiment of the present invention.

The developing apparatus C includes a developer containing container 4 as a developer containing portion, and a developing roller 5 as developing means, and agitating means 6 rotated in a direction shown by the arrow in FIG. 1 is disposed within the developer containing container 4. By rotating the agitating means 6, the developer T is supplied to the developing roller 5 while being loosened. In the illustrated embodiment, insulative magnetic one-component developer is used as the developer T. Further, the developing roller 5 includes a fixed magnet 5*a* therein so that the developer T is carried by rotation of the developing roller 5; meanwhile, tribo-electricity is applied to the developer by a developing blade 7 as developer layer thickness regulating member and a developer layer having a predetermined thickness is formed which is in turn supplied to a developing area on the photosensitive drum 1. The developer T supplied to the developing area is transferred onto the latent image on the photosensitive drum 1, thereby forming the toner image. The developing roller 5 is connected to developing bias applying means 33 (FIG. 3) so that developing bias obtained by overlapping AC voltage with DC voltage is applied to the developing roller.

On the other hand, in synchronism with the formation of the toner image, a recording medium picked up from a recording medium containing cassette 10 is conveyed to a transfer station by means of conveying means including a pick-up roller 11 and the like. A transfer roller 13 as transferring means is disposed at the transfer station, and, by applying voltage to the transfer roller, the toner image on the photosensitive drum 1 is transferred onto the recording medium P.

The recording medium P to which the toner image was transferred is conveyed to fixing means 14, where the unfixed toner image is fixed to the recording medium P. The fixing means includes a fixing roller 14*b* having a heater 14*a* therein, and a driving roller 14*c* so that the transferred toner image is fixed to the recording medium P by applying heat and pressure to the recording medium being passed between these rollers.

Thereafter, the recording medium P is discharged onto a discharge tray 16 by conveying means including a pair of rollers and a conveying path. The discharge tray 16 is disposed on an upper surface of a main body 100 of the laser beam printer A.

After the toner image is transferred to the recording medium P by the transfer roller 14, residual developer remaining on the photosensitive drum 1 is removed by cleaning means 8, thereby preparing for next image formation. The cleaning means 8 includes an elastic cleaning blade abutting against the photosensitive drum 1 and adapted to scrape the residual developer from the photosensitive drum 1 and to collect the scraped developer into a waste developer container 9.

Figure 2:
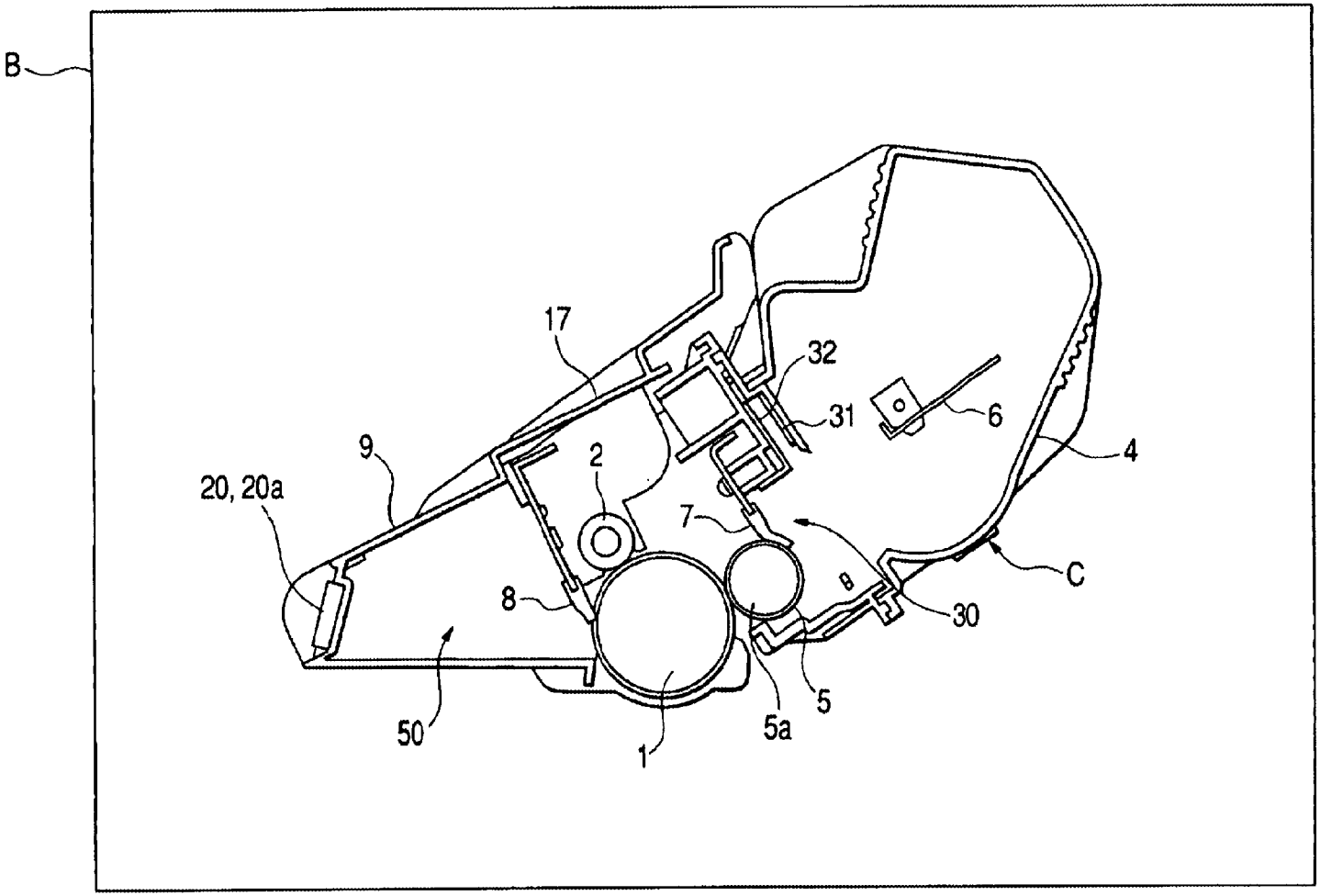
FIG. 2 is an enlarged sectional view of the process cartridge of FIG. 1.

In the illustrated embodiment, as shown in FIG. 2, in the process cartridge B, the photosensitive drum 1 and process means acting on the photosensitive drum 1—such as the electrifying roller 2, the developing apparatus including the developing means and the developer containing container 4 and the cleaning device 50 including the cleaning means and the waste developer container 9—are integrally joined together by a frame 17 as a cartridge unit. The process cartridge B can detachably be mounted to cartridge mounting means 18 of the main body 100 of the image forming apparatus by the operator.

Now, the developer amount detecting device according to the illustrated embodiment will be described. The laser beam printer A according to the illustrated embodiment includes the developer amount detecting device having developer remaining amount detecting means 30 capable of successively detecting a remaining amount of the developer as the developer T in the developing apparatus C is being consumed.

In the illustrated embodiment, the developer remaining amount detecting means 30 is of plate-antenna type. As shown in FIG. 2, in the illustrated embodiment, as a plate antenna, first and second metal plates 31, 32 as electrode metal plates are provided to extend along the entire longitudinal area of the developing apparatus C. The second metal plate 32 is opposed to the developing roller 5 in parallel therewith in a longitudinal direction thereof, and the first metal plate 31 is disposed substantially in parallel with the longitudinal direction of the second metal plate 32.

In this way, by arranging the first and second metal plates 31, 32 as the plate-antenna within the developing apparatus C and by measuring electrostatic capacity between the first and second metal plates 31, 32 and electrostatic capacity between the developing roller 5 and the second metal plate 32, an amount of the developer in the developing apparatus C can successively be ascertained.

Figure 3:
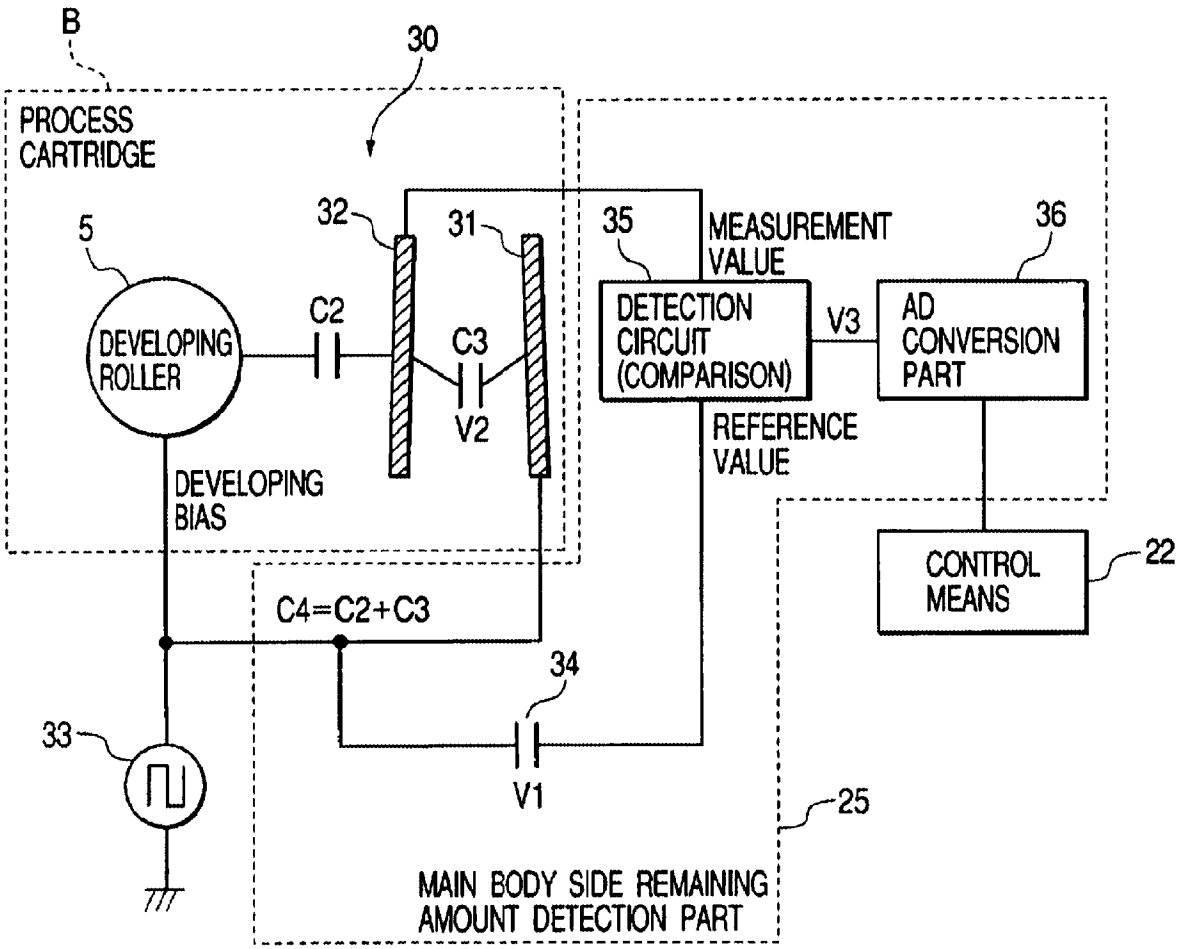
FIG. 3 is a schematic circuit diagram for explaining a circuit arrangement of a developer amount detecting device.

Further explaining a circuit arrangement of the developer amount detecting device also with reference to FIG. 3, in the illustrated embodiment, when the process cartridge B is mounted to the main body 100 of the image forming apparatus, the developing roller 5 and the first metal plate 31 are electrically connected to a developing bias circuit 33 as developing bias applying means or voltage applying means provided in the main body 100 of the apparatus. AC bias of about 2 KHz and DC bias of about −400 v (normal developing bias) are applied to the developing roller 5 and the first metal plate 31. As a result, AC electrical current flows between the developing roller 5 and the second metal plate 32 and between the first and second metal plates 31, 32, and resulting current value is measured by a detecting circuit 35 as an electrical current measuring device, and the electrostatic capacity is measured from the current value.

When predetermined AC bias is outputted from the developing bias circuit 33, the applied bias is applied to a reference capacitance 34, developing roller 5 and first metal plate 31, respectively. As a result, voltage V1 is generated on both ends of the reference capacitance 34, and electrical current corresponding to electrostatic capacity C4 is generated between the first and second metal plates 31, 32. The electrical current value is converted into voltage V2 by calculation. The electrostatic capacity C4 is the sum of electrostatic capacity C2 between the developing roller 5 and the second metal plate 32 and electrostatic capacity between the first and second metal plates 31, 32.

The detecting circuit 35 serves to produce voltage V3 from a difference between the voltage V1 generated on both ends of the reference capacitance 34 and voltage V2 between the first and second metal plates 31, 32 and to output the voltage V3 to an A/D converting portion 36. The A/D converting portion 36 serves to output a result of conversion of the analogue voltage V3 to a digital value to control means 22. In the illustrated embodiment, a main body side remaining amount detecting portion 25 is constituted by the reference capacitance 34, detecting circuit 35 and A/D converting portion 36.

The control means 22 serves to recognize the amount of the developer within the process cartridge B on the basis of the voltage value (detection voltage value V3) digitally converted, which will be fully described later.

As shown in FIG. 2, the process cartridge B according to the illustrated embodiment has a read/write memory 20 as storing means disposed on an upper side surface of the waste developer container 9, and a cartridge side transmitting portion 20*a* for controlling read/write of information with respect to the memory 20. When the process cartridge B is mounted to the main body 100 of the image forming apparatus, the cartridge side transmitting portion 20*a* is opposed to a main body control portion 21 (FIG. 4) of the main body 100 of the image forming apparatus. Further, the main body control portion 21 also includes a function as main body side transmitting means.

As the storing means (memory) 20 used in the present invention, an electronic memory based on normal semiconductor such as a nonvolatile memory a combination of a volatile memory and a back-up battery or the like can be used without any limitation. Particularly, in case of a memory of a noncontact type for effecting data communication between the memory 20 and a read/write IC via an electromagnetic wave, since the cartridge side transmitting portion 20*a* may not be contacted with the main body control portion 21, there is no danger of causing poor contact due to poor mounting of the process cartridge B, thereby permitting control with high reliability.

Read/write control means (communication means) for effecting read/write of information with respect to the memory is constituted by these two control portions. In the illustrated embodiment, the memory 20 may have capacity sufficient to merely store a plurality of information data such as use amount of the cartridge and cartridge property value. Further, the memory is designed to successively re-write the use amount of the cartridge. Although various information data are stored in the memory 20, in the illustrated embodiment, at least information regarding a minimum value of detection voltage value (referred to as "PAF value" or "plate-antenna full value" hereinafter), W value information and Y% value information (which will be described later) are stored.

Next, memory controlling arrangement and detection processing arrangement for the developer amount will be described also with reference to FIG. 4. The memory 20 is located at the process cartridge B side and the main body control portion 21 is located at the main body 100 side. The main body control portion 21 is provided with control means 22, a calculating portion 23, a remaining amount detection correction table (remaining amount detection correction table storing portion) 24, a main body side remaining amount detecting portion 25 and a calculation formula (calculation formula storing portion) 26.

An output signal from the developer remaining amount detecting means 30 according to the illustrated embodiment is converted into a voltage value signal (digital signal) by the main body side remaining amount detecting portion 25 as mentioned above and is inputted to the calculating portion 23. Further, when the process cartridge B is mounted to the main body 100 of the apparatus, the information data stored in the memory 20 of the process cartridge B can always be communicated with the calculating portion 23 of the main body control portion 21, so that, in the calculating portion 23, calculation processing is effected on the basis of the calculation formula 26, by using a signal from the main body side remaining amount detecting portion 25 and the information from the memory 20. On the basis of a calculation processing result in the calculating portion 23 the control means 22 verifies the data by using the developer remaining amount detection correction table (remaining amount detection correction table) 24 to properly correct the detection value of the developer remaining amount, thereby determining a developer remaining amount level.

Figure 5:
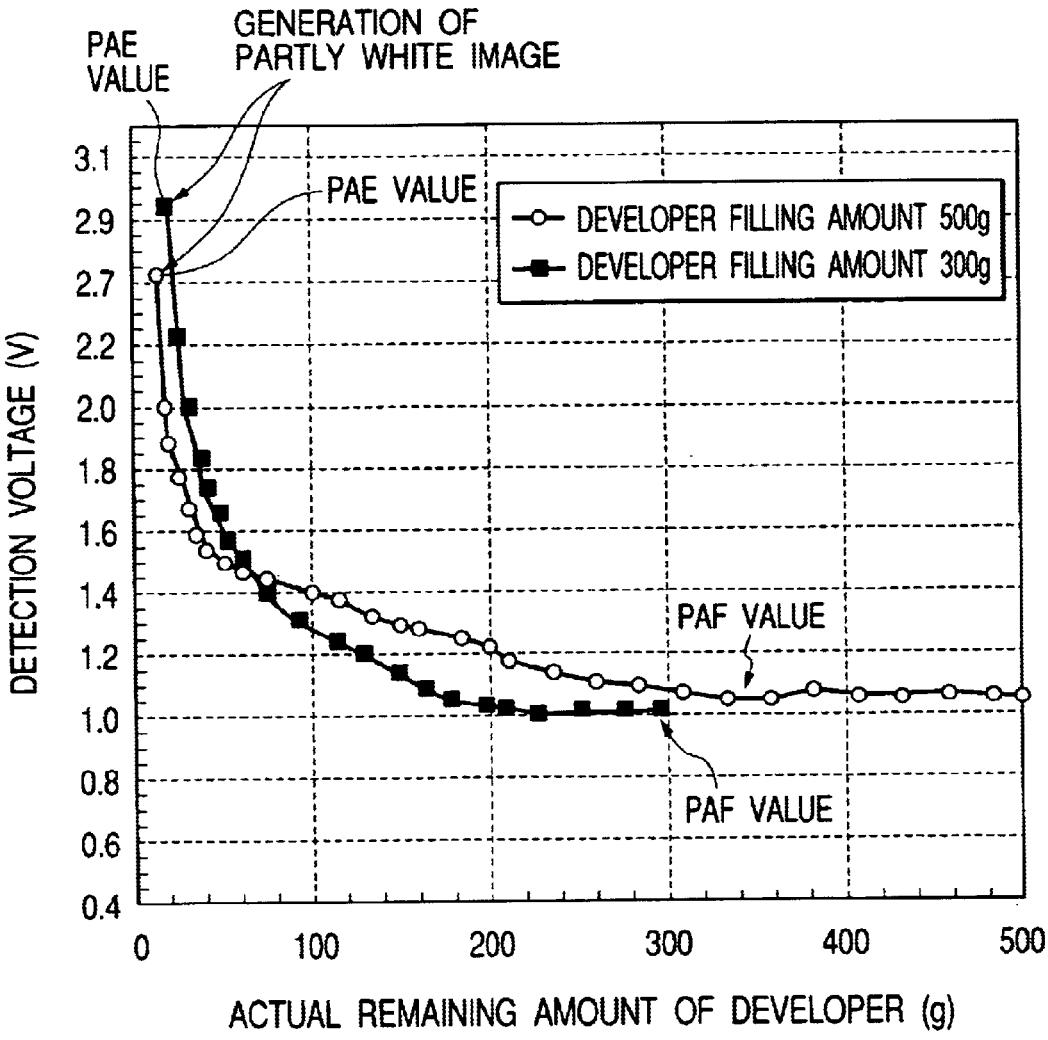
FIG. 5 is a graph showing a relationship between actual developer remaining amounts of cartridges having different developer loading amounts and detection voltage values of the developer amount detecting device.

In the developer amount detecting device according to the illustrated embodiment having the above-mentioned construction, the electrostatic capacity value detected by the developer remaining amount detecting means 30 is converted into a voltage signal in the main body 100 of the apparatus and is outputted as the detection voltage value (V3) as shown in FIG. 5 in accordance with the amount of the developer in the developing apparatus C. Namely, with the arrangement according to the illustrated embodiment, when the developer amount is maximum, the detection voltage value, i.e., the electrostatic capacity becomes minimum. The detection voltage value in this case is the PAF value. As the developer amount is decreased, the detection voltage value is increased. The detection voltage value is increased until the developer is used up completely or until the developer is decreased to the extent that a so-called white void image is generated, i.e., a proper image cannot be formed. The detection voltage value in this case is a PAF (plate antenna empty) value.

Incidentally, in the illustrated embodiment, while an example that the circuit arrangement in which the detection voltage value is increased as the electrostatic capacity value measured by the developer remaining amount detecting means 30 is decreased due to the reduction of the developer amount was explained, a relationship between the electrostatic capacity and the voltage can be varied with a circuit, and thus, the relationship between the electrostatic capacity and the detection voltage value may be the same decreasing function or the same increasing function, and the present invention is not limited to the illustrated relationships.

FIG. 5 shows a relationship between developer amounts (g; grams) and detection voltage values (V) as the measured result, when two process cartridges B1, B2 (in which initial loading amounts of the developer T are different from each other and the constructions are the same) are mounted to the main body 100 of the apparatus. In this figure, a curve obtained by plotting white circles shows a relationship between the actual developer amount (g) and the detection voltage values (V) in a process cartridge B1 in which a developer amount (initial loading amount) is 500 g and image formation of 10000 sheets is permitted, and a curve obtained by plotting black squares shows a relationship between the actual developer amount (g) and the detection voltage values (V) in a process cartridge B2 in which a developer amount (initial loading amount) is 300 g and image formation of 6000 sheets is permitted.

Figure 6:
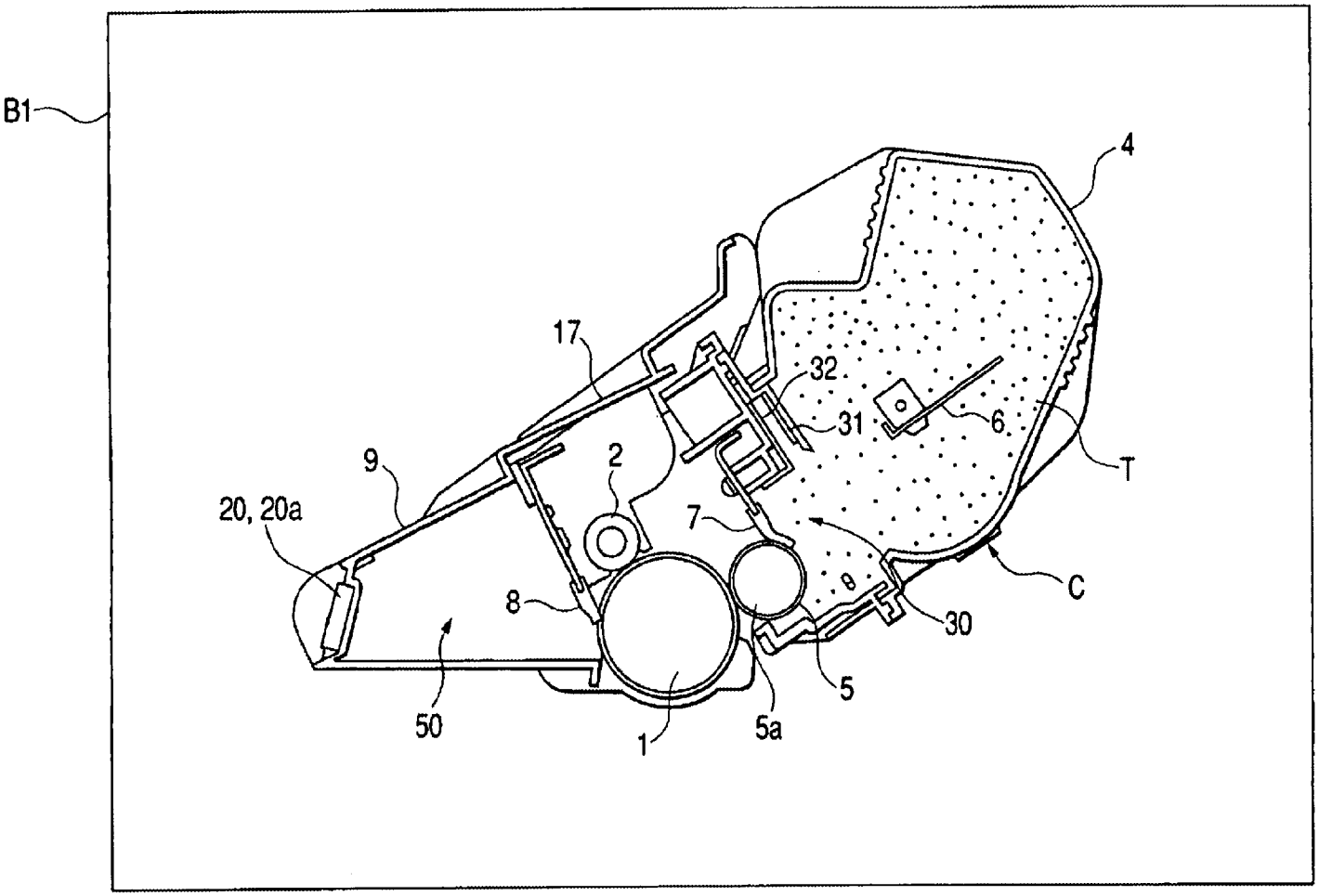
FIG. 6 is a schematic sectional view showing a cartridge B1 having developer loading amount of 500 g mountable to the image forming apparatus of FIG. 1.
Figure 7:
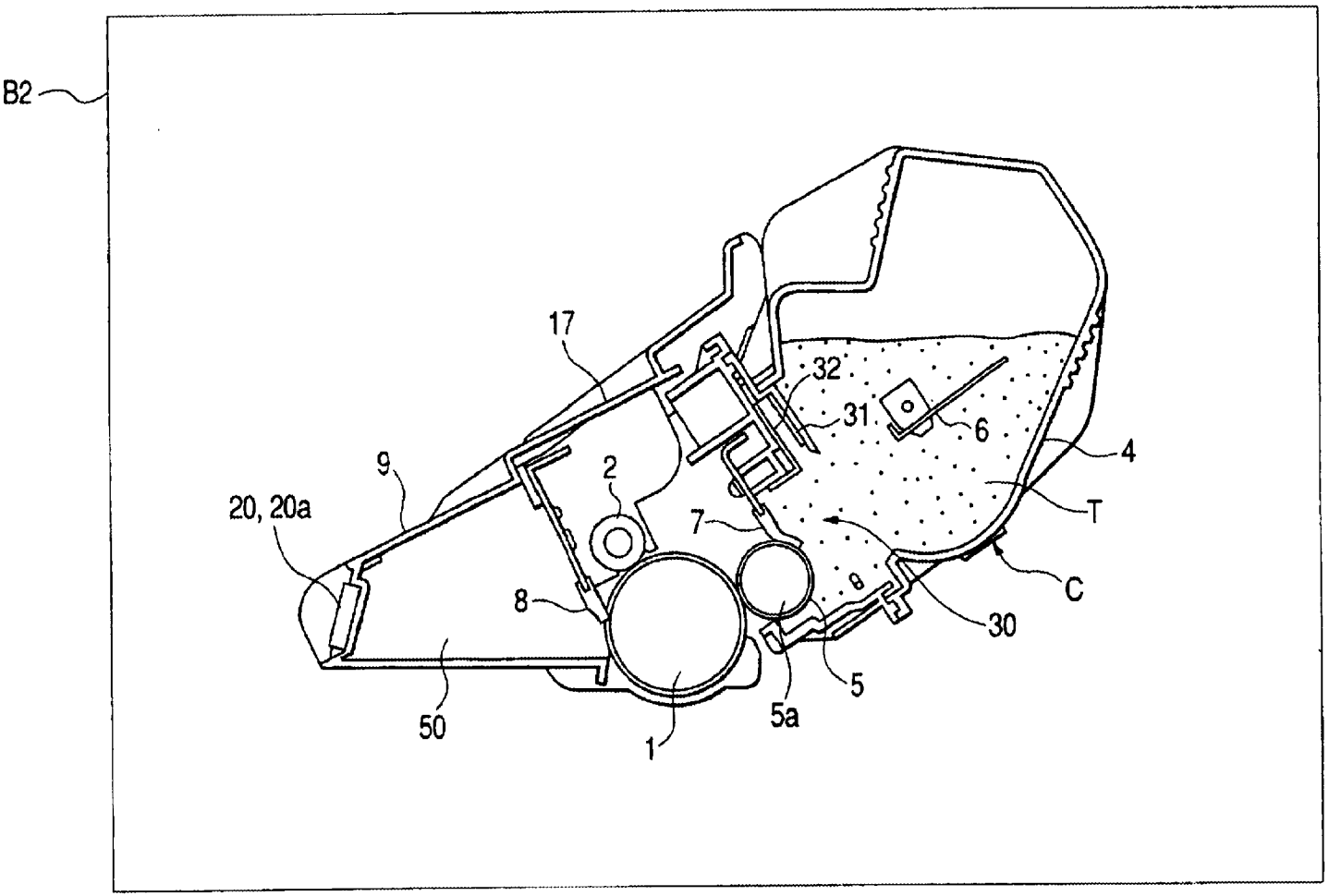
FIG. 7 is a schematic sectional view showing a cartridge B2 having developer loading amount of 300 g mountable to the image forming apparatus of FIG. 1.

Although FIGS. 6 and 7 show process cartridges B1, B2 having developer capacities of 500 g (image formation permitting number of about 10000) and of 300 g (image formation permitting number of about 6000), as shown, positional relationships of the developer remaining amount detecting means 30 of the respective process cartridges, i.e., positional relationships between the first and second metal plates 31, 32 and the developing rollers 5 are the same, and only the developer loading amounts are different. In general, in process cartridges B1, B2 of different types, i.e., having different developer capacities (initial loading amounts) in the illustrated embodiment, the PAF values are different. In the illustrated embodiment, in the process cartridges B1, B2 having toner loading amounts of 500 g and 300 g, the PAF values were 1.05 V and 1.0 V, respectively.

Here, as mentioned above, in the developer amount detecting device of electrostatic capacity type such as plate-antenna type, by previously seeking a relationship between the developer amount and "detected electrostatic capacity, i.e., detection voltage value", the developer amount can be detected by using a table and/or calculation formula based on such a relationship.

However, as mentioned above, in an image forming apparatus to which process cartridges B of different types (having different PAF values) can be mounted, only on the basis of the relationship between the developer amount and the electrostatic capacity sought regarding a certain specific process cartridge, the developer amount cannot be detected correctly.

Thus, by previously seeking the PAF values of the respective process cartridges B, it is considered to propose a method in which by using predetermined tables and/or calculation formulae based on the pre-set relationships between the detection values of electrostatic capacity (detection voltage values) and the developer amounts and by detecting change in detection voltage value (V) from the PAF value of each process cartridge, the proper developer amount of each process cartridge is detected.

Namely, as is in the laser beam printer A according to the illustrated embodiment, even in case of the image forming apparatus to which the process cartridges B1, B2 having different developer capacities (initial loading amounts) can be mounted, it is considered that the developer amounts of respective cartridges are detected by previously determining PAF values of the process cartridges of different types and by storing the determined PAF values in the memory 20 and by detecting changes in detection voltage values (V) from the PAF values on the basis of the tables and/or calculation formulae based on the pre-set relationship between the detection values of electrostatic capacity (detection voltage values) and the developer amounts.

However, by carefully investigating the changes in detection voltage values as to the reduction of developer T shown in FIG. 5, it can be found that, regarding the process cartridges B1, B2 having different developer capacities (initial loading amounts), the relationship between the developer amount (g) and the detection voltage value (V) of the process cartridge B1 differs from that of the process cartridge B2.

That is to say, although not limited, according to the inventor's investigation, as the loading amount of the developer T is increased, the density of the developer within the developer containing container 4 is increased by its own weight to facilitate clogging. For this reason, it is considered that, depending upon the difference in the initial loading amount of the developer T, density and distribution of the developer T remaining in the developer container are differentiated, and, thus, the change in electrostatic capacity detected by the developer remaining amount detecting means 30, i.e., transition of output of the developer remaining amount detecting means 30 is differentiated.

Figure 15:
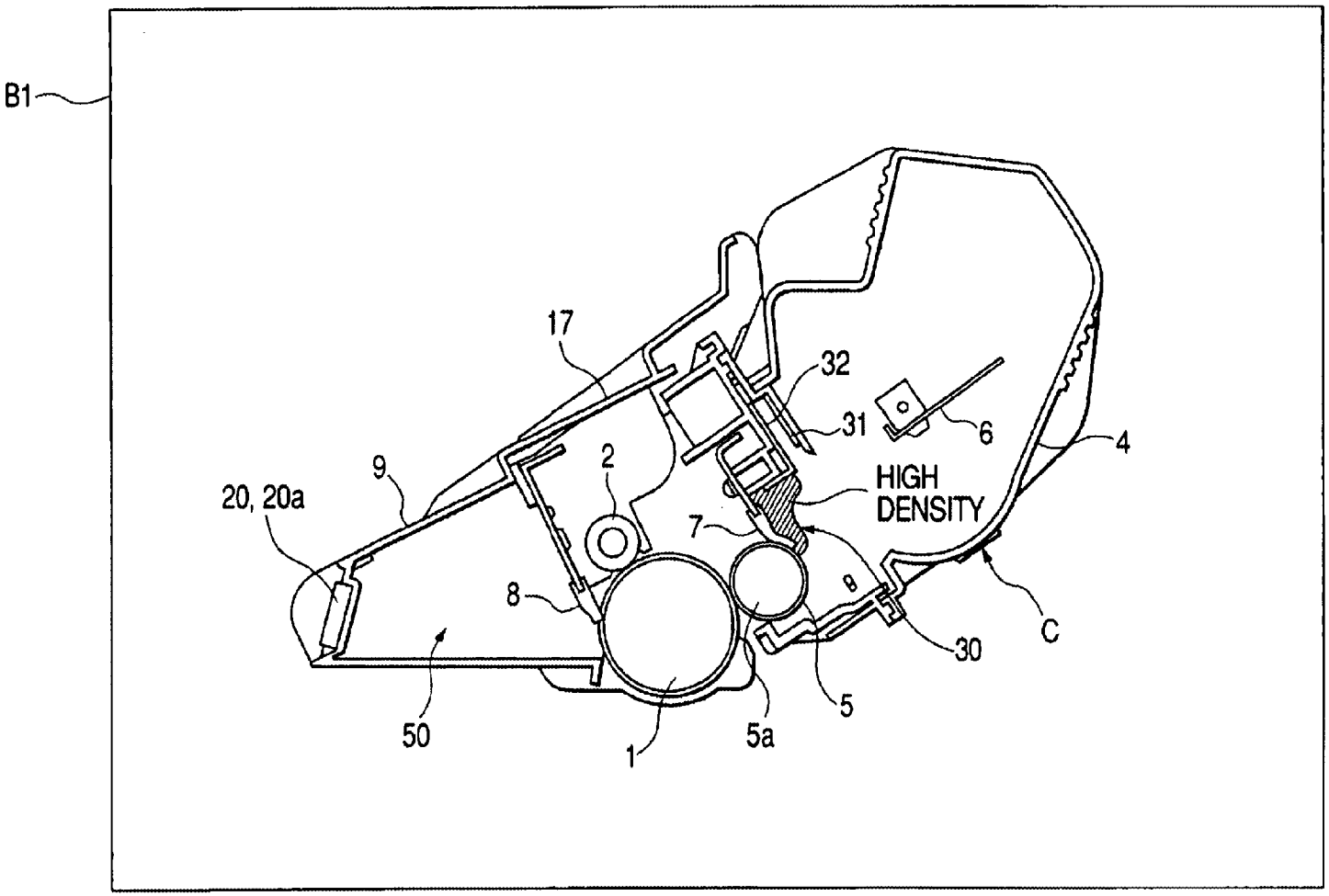
FIG. 15 is a view showing a remaining toner condition at a point that a white void image is generated when image output is being continued by using the cartridge B1 having loading amount of 500 g.
Figure 16:
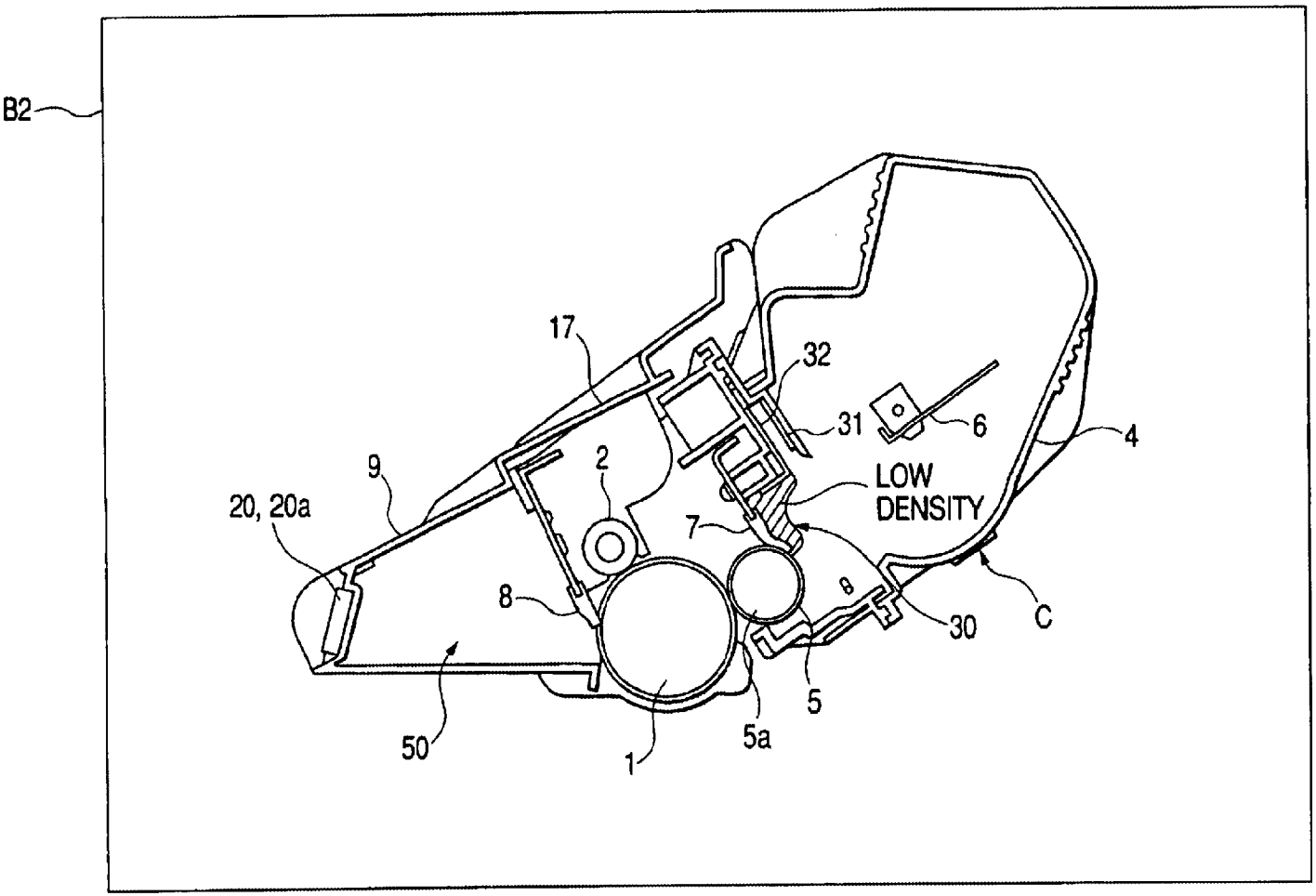
FIG. 16 is a view showing a remaining toner condition at a point that a white void image is generated when image output is being continued by using the cartridge B1 having loading amount of 300 g.

For example, FIG. 15 shows a condition of toner remaining in the container when a white void image is generated after images continue to be outputted by using the cartridge B1, and FIG. 16 shows a condition of toner remaining in the container when a white void image is generated after images continue to be outputted by using the cartridge 52. As can be understood from comparison of two Figures, between the cartridge B1 having much loading amount and the cartridge B2 having less loading amount, when the white void image is generated (i.e., condition that the toner remaining amount is very small), densities of toners adhered to the remaining amount detecting antenna portions are different from each other (B1 has higher density). For this reason, output voltages (PAF values) of the remaining amount detecting antenna portion upon generation of the white void image are differentiated as shown in FIG. 5.

Even between process cartridges B having the same capacity, i.e., the same initial loading amount, such deviation of the output of the developer remaining amount detecting means 30 may occur, for example, by a difference in fluidity due to difference in a manufacturing condition of the developer T and/or dispersion in construction due to a difference in manufacturing a condition of the developer containing container 4.

Accordingly, in order to successively detect the developer amounts of the process cartridges B1, B2 always correctly, the deviation in transition of the output of the developer remaining amount detecting means 30 must be corrected in consideration of the above-mentioned difference in developer capacity, difference in manufacturing condition of the developer T and/or tolerance of constructural elements of the developing apparatus C such as the developer containing container 4.

In the present invention, in order to achieve such correction, parameter values depending upon the developer capacity (initial loading amount), manufacturing condition of the developer T and/or manufacturing condition of the developer containing container 4 are included in the calculation formula, thereby correcting the transition of the output of the developer remaining amount detecting means 30.

To this end, in the illustrated embodiment, the following control is performed:

(1) The process cartridge B is provided with the memory 20, and a "minimum value of the detection voltage value (V3) obtained by the developer amount detecting device (maximum value of electrostatic capacity value), i.e., PAF value" and a "parameter value W corresponding to the developer capacity (initial loading amount) of the process cartridge B (=data associated with the remaining amount of developer remaining in the container when the white void image is generated)" are written in the memory 20. The W value is varied with the loading amount. The greater the loading amount the smaller the W value.

(2) A weighting function using a relationship between the PAF value and the developer remaining amount is previously stored in the main body control portion 21 or in the memory 20 as the calculation formulas 26. The parameter value W is used in this function.

(3) By successively introducing correction values Z of the weighting function into the relationship between the weighting function and the detection voltage value V3, a correction value Z satisfying the relationship is determined.

(4) By using the developer remaining detection correction table 24, the developer remaining amount is calculated on the basis of the determined correction value Z.

(5) The result is displayed on the display means at any time.

In this way, even if the transition of the detection voltage value (electrostatic capacity value) is deviated due to the difference in type of the process cartridge B, i.e., difference in developer capacity (initial loading amount) in the illustrated embodiment), the developer remaining amount can be detected successively.

Further explaining the above-mentioned control in the illustrated embodiment, by setting a range until the detection voltage value is increased from the PAF value by a predetermined amount as a developer usable range and by successively detecting the developer remaining amount (remaining %) within said range, the weighting function becomes as follows:

$$F(PAF, W, Z)=|Z((\alpha-1)PAF+W)+PAF| \quad (1)$$

(where, $\alpha$ and PAF are constant, Z is correction value of weighting function and W is parameter value). This equation can be obtained from $$\{F=|Z(PAF-PAF)+PAF|,\ PAE=\alpha PAF+W\}.$$

Figure 4:
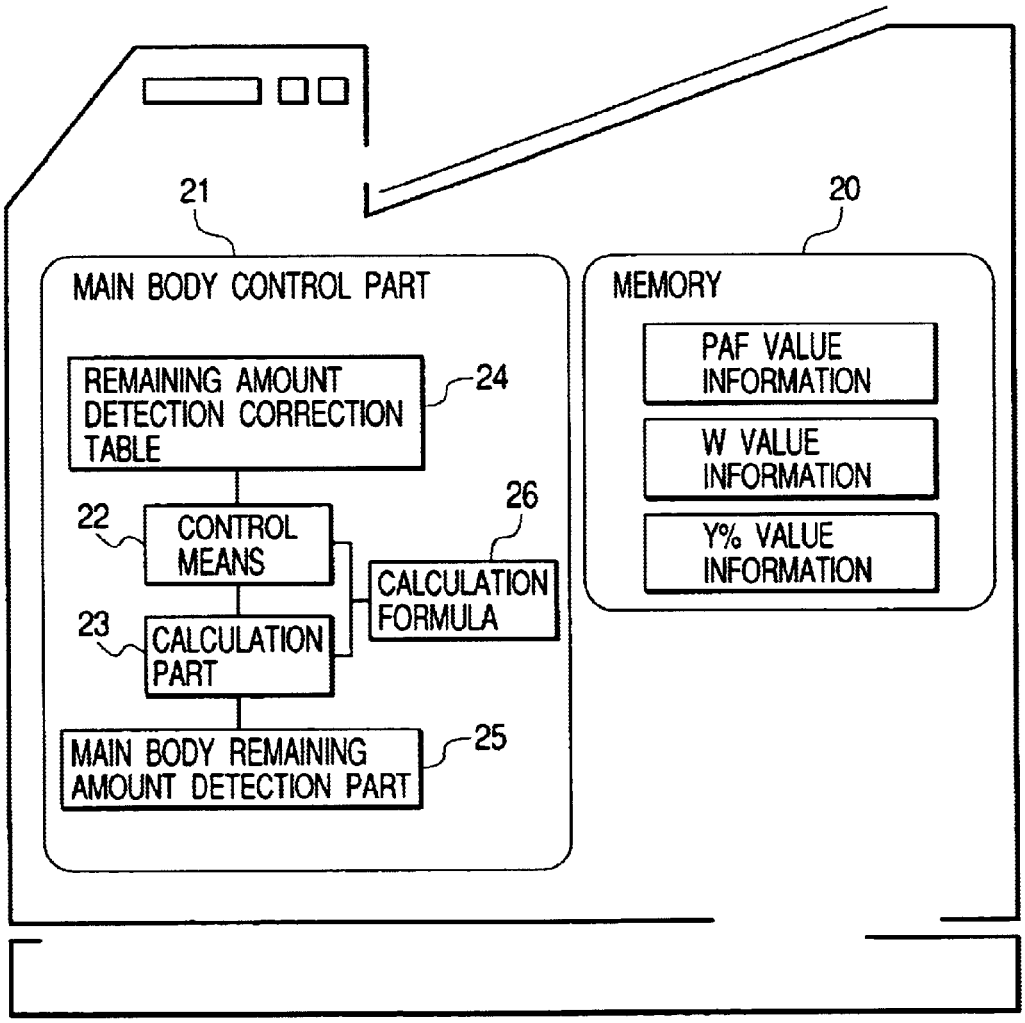
FIG. 4 is a schematic constructural view for explaining a memory control arrangement of the cartridge according to the present invention.

In the illustrated embodiment, the above equation (1) is stored in a predetermined storing area of the main body control portion 21 as the calculation formula 26 (FIG. 4). Incidentally, as mentioned above, the equation can be stored in the memory 20 of the process cartridge B.

Here, the constant $\alpha$ is constant previously determined depending on the fact that the usable range of the developer is selected as a range of how much the detection voltage value is increased from the PAF value. For example, the usable range can be selected as a range until the developer remaining amount becomes zero (0 g) or a range that the developer remaining amount is decreased to the extent that the white void image is generated so as not to obtain the image having predetermined image quality.

In the illustrated embodiment, the parameter value W is a factor for determining the property of the cartridge and is altered in accordance with the developer capacity (initial loading amount) and is previously set.

Further, as mentioned above, in the illustrated embodiment, regarding the process cartridge B of the same type (having the same developer capacity (initial loading amount) in the illustrated embodiment), it is assumed that the PAF value is substantially constant during the transition of the detection voltage value, and the PAF value is previously stored in the memory 20.

Further, the correction value Z is a value dividing the developer usable range with a proper interval and is previously corresponded to the developer amount and is stored in a predetermined storing area of the main body control portion 21 as the remaining amount detection correction table 24 (FIG. 4). The following Table 1 shows an example of the remaining amount detection correction table 24. Table 1 shows an example of the remaining amount detection correction table 24 used in the process cartridges B1, B2 having the developer capacities of 500 g and 300 g, respectively.

TABLE 1

| developer remaining amount as to 500 g initial amount (g) | remaining amount display (%) | Z |
|---|---|---|
| 20 | 0 | |
| 20 | 0 | |
| 20 | 0 | 0.99 |
| 25 | 1 | 0.95 |
| 45 | 5 | 0.78 |
| 70 | 10 | 0.65 |
| 95 | 15 | 0.50 |
| 120 | 20 | 0.45 |
| 145 | 25 | 0.35 |
| 170 | 30 | 0.25 |
| 195 | 35 | 0.20 |
| 220 | 40 | 0.18 |
| 500 | 100 | 0.10 |

In the claculating portion 23, the correction values Z are successively introduced into the following formula (2) representing a relationship between the above-mentioned weighting function F (PAF, W, Z) and the detection voltage value (V3), thereby obtaining a calculation values:

$$|V3| \geqq |Z((\alpha-1)PAF+W)+PAF| \quad (2)$$

The control means 22 determines the correction value Z satisfying the above formula (2) on the basis of the calculation values. The control means 22 recognizes the developer amount from the determined correction value Z by verifying the developer remaining amount detection correction table 24 (calculates the remaining amount display level).

For example, from the remaining amount detection correction table 24 shown in Table 1, when Z=0.10 corresponding to the maximum developer remaining amount is introduced, if the formula (2) is satisfied, it is judged that the developer remaining amount is 100% (500 g), and, for example, the fact that the developer remaining amount is 100% is notified. On the other hand, when Z=0.10 is introduced, if the formula (2) is not satisfied, then, Z=0.18 is introduced into the formula (2). In this case, if satisfied, it is judged that the developer remaining amount of 40% (22 g), and, the fact that the developer remaining amount is 40% is notified. Namely, if the formula (2) is not satisfied by smaller Z value, the Z value is gradually increased until the formula (2) is satisfied, and, the Z value satisfying the formula (2) is recognized as the developer remaining amount.

In the illustrated embodiment, the main body control portion 21 displays the developer remaining amount % on the display 40 of the main body 100 of the apparatus as the calculated developer amount. Further, if it is judged that the developer remaining amount is 0%, "no developer" can be displayed as alarm. Incidentally, as mentioned above, no developer, i.e., developer remaining amount of 0% also includes a case where the developer is decreased to the extent that the image formation having predetermined Image quality becomes impossible.

Figure 8:
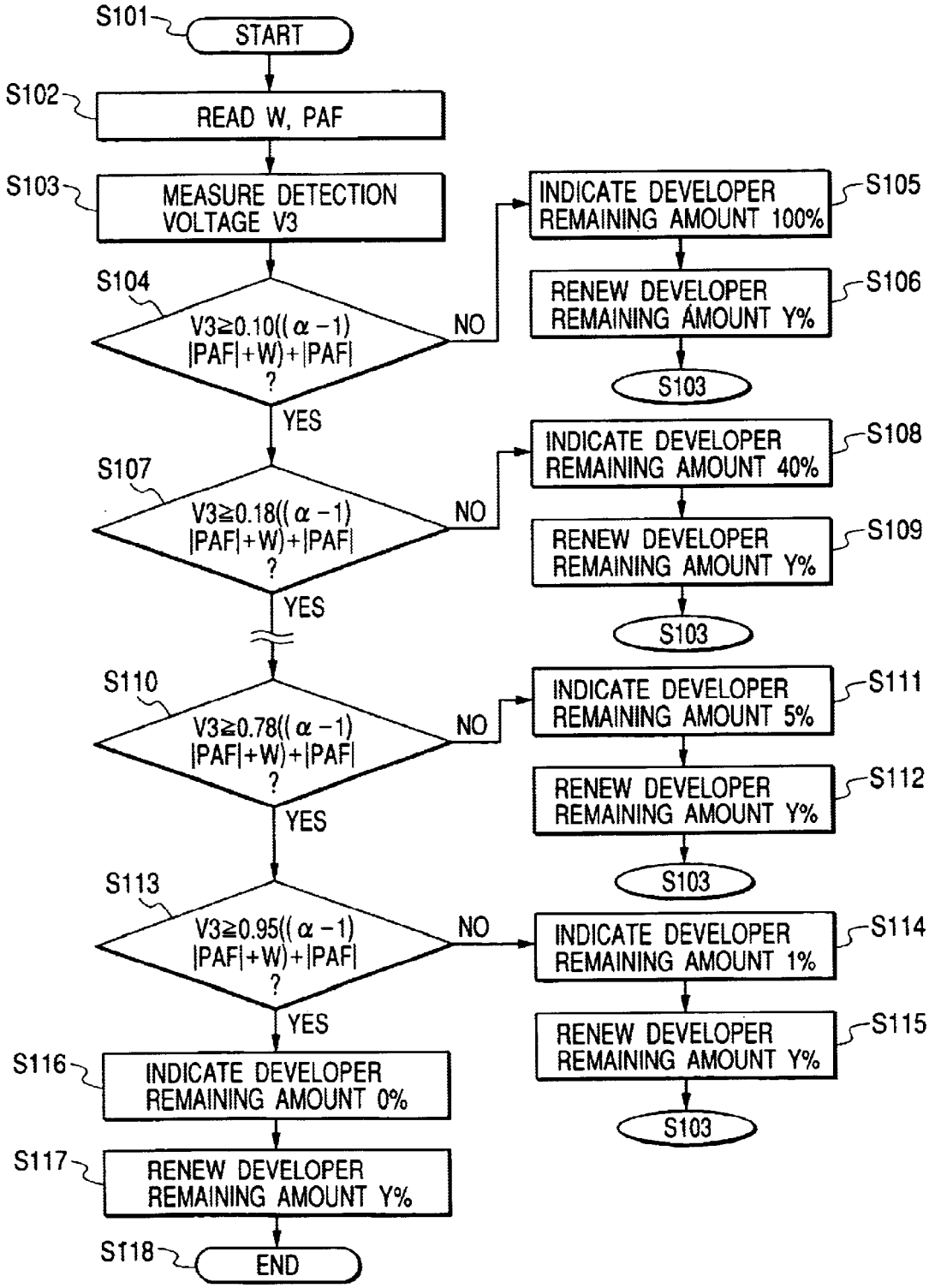
FIG. 8 is a flowchart showing a developer amount detecting operation according to a first embodiment of the present invention.

Next, the successive developer remaining amount detecting operation according to the illustrated embodiment will be explained with reference to a flowchart (steps 1 to 18: S101 to S118) of FIG. 8. S101: A power supply switch of the main body 100 of the apparatus is turned ON to start the operation of the main body 100 of the apparatus (START).

S102: The control means 22 of the main body 100 of the apparatus reads out the parameter value W information and the PAF value from the memory 20 of the process cartridge B.

S103: The main body side remaining amount detecting portion 25 measures the detection voltage V3.

S104: The calculating portion 23 obtains the calculation value by introducing Z−0.10 of the remaining amount detection correction table 24 into F (PM, W, Z), and the control means 22 is judges whether V3 exceeds F (PM, W, Z) or not. If YES, the program goes to S107. On the other hand, if NO, the control means 22 emits a signal notifying the fact that the developer remaining amount if 100% and displays this fact on the display means 40 of the main body 100 of the apparatus (S105). Then, the developer remaining amount Y% value information in the memory 20 is revised or renewed (S106), and the program is returned to S103.

S107: The calculating portion 23 obtains the calculation value by introducing Z=0.18 of the remaining amount detection correction table 24 into F (PM, W, Z), and the control means 22 is judges whether V3 exceeds F (PM, W, Z) or not. If NO, the control means 22 emits a signal notifying the fact that the developer remaining amount is 40% and displays this fact on the display means 40 of the main body 100 of the apparatus (S108). Then, the developer remaining amount Y% value information in the memory 20 is revised (S109), and the program is returned to S103. On the other hand, if YES, in accordance with the remaining amount detection correction table 24 of Table 1, then, Z=0.20 is introduced. Thereafter, as the above-mentioned flowchart, the procedures are repeated until Z=0.95. Incidentally explanation of such repetition will be omitted.

S110: The calculating portion 23 obtains the calculation value by introducing Z=0.78 of the remaining amount detection correction table 24 into F (PAF, W, Z), and the control means 22 is judges whether V3 exceeds F (PAF, W, Z) or not. If NO, the control means 22 emits a signal notifying the fact that the developer remaining amount is 5% and displays this fact on the display means 40 of the main body 100 of the apparatus (S111). Then, the developer remaining amount Y% value information in the memory 20 is revised (S112), and the program is returned to S103. On the other hand, if YES, the program goes to S113.

S113: The calculating portion 23 obtains the calculation value by introducing Z=0.95 of the remaining amount detection correction table 24 into F (PAF, W, Z), and the control means 22 is judges whether V3 exceeds F (PAF. W, Z) or not. If NO. the control means 22 emits a signal notifying the fact that the developer remaining amount is 1% and displays this fact on the display means 40 of the main body 100 of the apparatus (S114). Then, the developer remaining amount Y% value information in the memory 20 is revised (S115), and the program is returned to S103. On the other hand, if YES, the program goes to S116.

S116: The control means 22 emits information notifying the fact that the developer remaining amount is 0% or that the process cartridge should be exchanged and displays this fact on the display means 40 of the main body 100 of the apparatus.

S117: The developer remaining amount Y% value information in the memory 20 is revised.

S118: The program is ended.

Since the greater the toner loading amount the smaller the W value, when the cartridge B1 having the great loading amount is mounted, display regarding the remaining amount % or request for exchange of the cartridge is effected at a point that the detection remaining amount of the remaining amount detecting antenna is much more than that when the cartridge B2 having the small loading amount is mounted.

Figure 9:
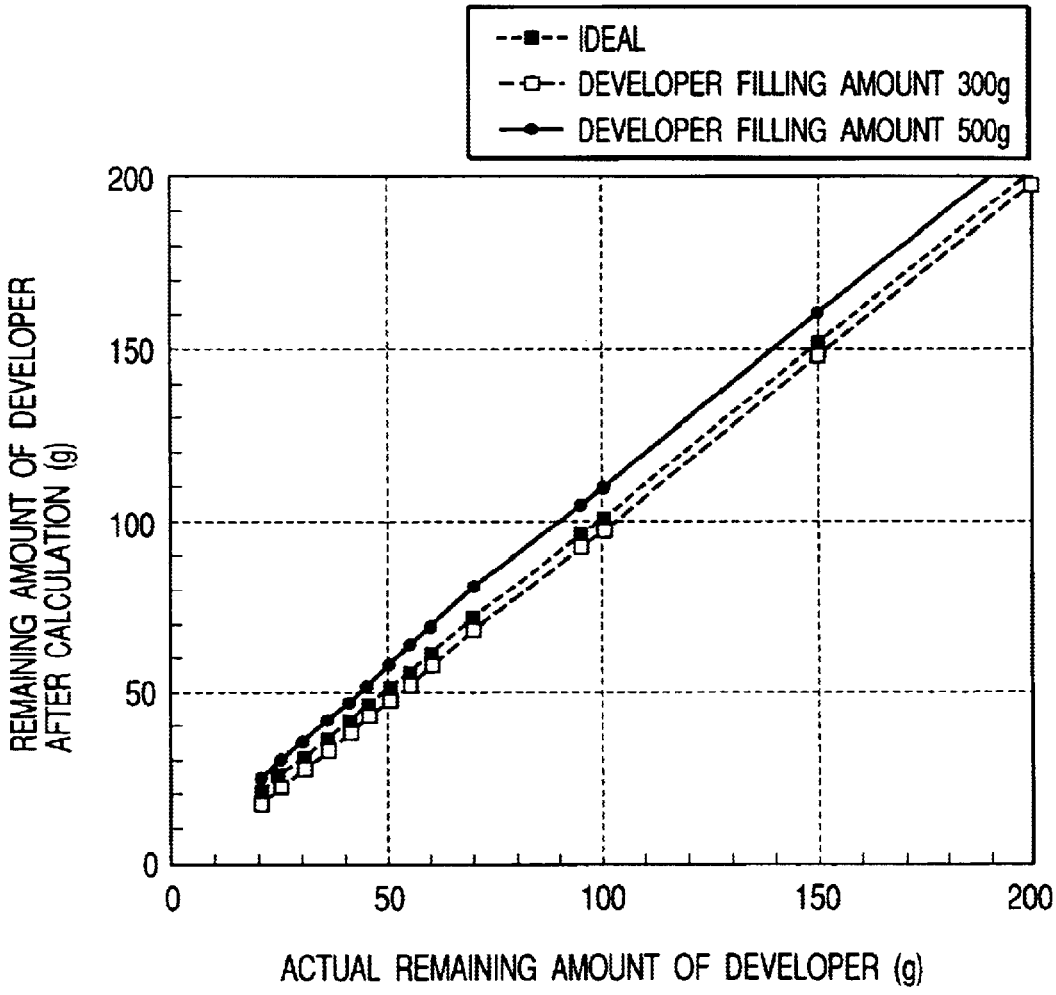
FIG. 9 is a graph showing a relationship between calculated developer amount values obtained by calculation in the first embodiment and actual developer amounts.

Regarding the process cartridges B having different developer capacities (initial loading amounts) (500 g, 300 g), the developer amounts (g) actually remaining in the developing apparatus C and the developer remaining amounts (g) sought by the calculating processing by effecting the control according to the above-mentioned flowchart were compared and evaluated. As a result, as shown in FIG. 9, the difference in developer capacity between the cartridges was absorbed and the developer remaining amount could successively be detected with high accuracy. From this fact, for example, after the process cartridge B1 was bought, even when the process cartridge B2 having different developer capacity is newly added, the developer remaining amount can be detected successively and correctly by revising the parameter value W stored in the memory 20.

As mentioned above, according to the illustrated embodiment, the deviation of transition of electrostatic capacity detection value (detection voltage value) caused due to inherent difference of the cartridge such as difference in developer capacity (initial loading amount) can be eliminated and the developer amount for each cartridge can always be calculated correctly.

Second Embodiment

Next, another embodiment of the present invention will be explained. In a second embodiment, constructions of an image forming apparatus and of a process cartridge are fundamentally the same as those in the first embodiment, and control of developer remaining amount detection by using storing means (memory) 20 is different. Accordingly, elements or parts having the same constructions and functions are designated by the same reference numerals, and detailed explanation thereof will be omitted, and only features of the second embodiment will be described.

In the first embodiment, an example that, in various process cartridges B1, B2 of different types (i.e., having different developer capacities (initial loading amounts) in the first embodiment), the PAF value regarding the transition of the detection voltage value is assumed to be substantially constant so long as the same type process cartridges and the PAF value is previously stored in the memory 20 was explained. However, the PAF values may have slight dispersion between the respective same type process cartridges.

Thus, in the second embodiment, the PAF value is revised at any time during the image formation. By doing so, not only the difference in kind of the process cartridge B (difference in developer capacity) but also the dispersion between the process cartridges can be absorbed, and the developer remaining amount can successively be detected more correctly.

Further explaining, in the second embodiment, the process cartridge B is provided with storing means 20 same as that in the first embodiment. In the image forming apparatus according to the second embodiment, the memory 20 and control construction for the memory 20 are the same as those in the first embodiment.

As is in the first embodiment also in the second embodiment, the electrostatic capacity value detected by the developer remaining amount detecting means 30 is converted into voltage by the main body 100 of the image forming apparatus and is controlled with a voltage value. The detection voltage value is detection voltage value (V3) which is the sum of electrostatic capacity measured between the first and second metal plates 31, 32 (as plate antenna) and electrostatic capacity measured between the second metal plate 32 and the developing roller 5.

As explained in connection with the first embodiment, when the developer amount is maximum, the detection voltage value indicates minimum PAF value (electrostatic capacity is maximum). The PAF value is written in the memory 20 in a condition that the loading of the developer into the developer containing container 4 is completed, i.e., a condition that the space between the first and second metal plates 31, 32 and the space between the second metal plate 32 and the developing roller 5 are filled with the developer. In the illustrated embodiment, during the operation of the laser beam printer A, if the detection voltage value indicates minimum (electrostatic capacity is maximum), the detection voltage value is written in the memory as PAF value at that time (i.e., revised).

Figure 10:
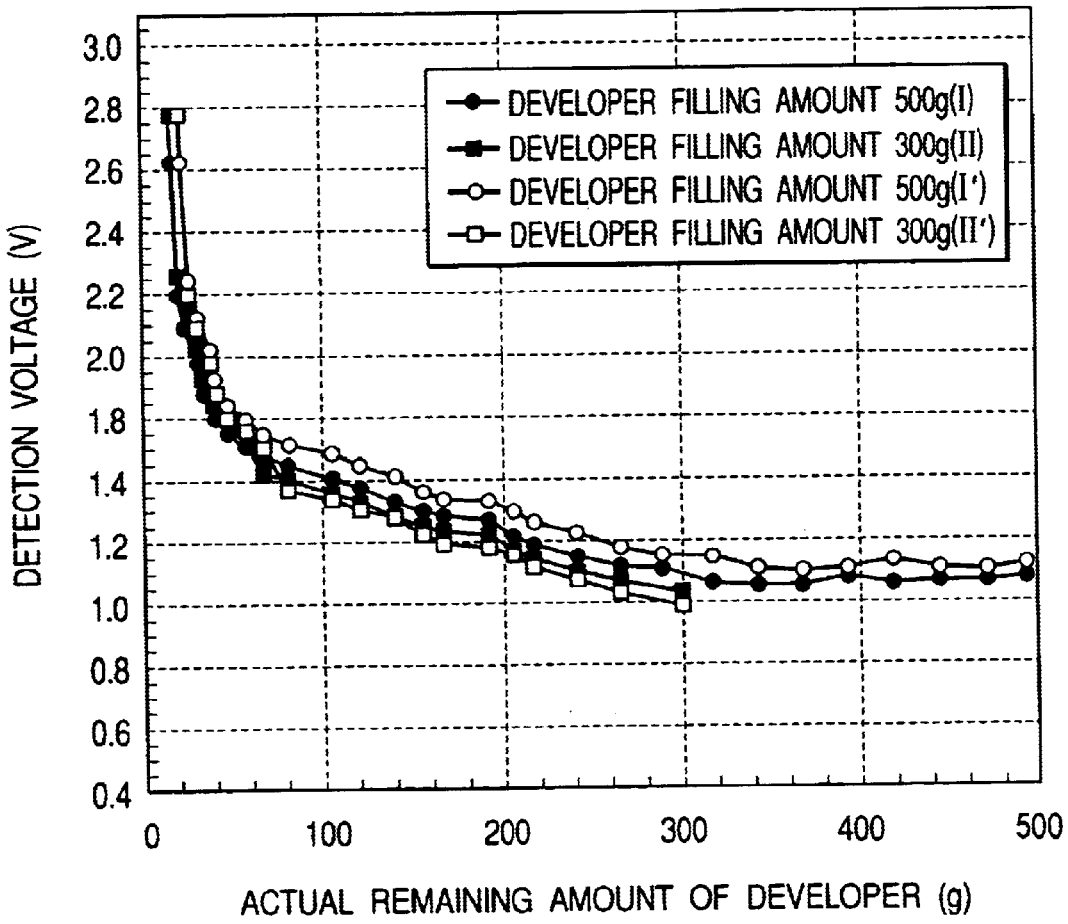
FIG. 10 is a graph showing a relationship between actual developer remaining amounts and detection voltage values of the developer amount detecting device, regarding two sets of cartridges having different developer loading amount.

FIG. 10 shows a relationship between the developer remaining amount and the detection voltage, regarding two sets of process cartridges B1, B2 of different types (having different developer capacities (initial loading amounts), i.e., two process cartridges B1 (1, 1') having developer capacity of 500 g and two process cartridges B2 (II, II') having developer capacity of 300 g.

As can be understood from FIG. 10, if the developer capacities (initial loading amounts) are differentiated, the changes in electrostatic capacity detection value as to reduction of the developer amount, i.e., transitions of the detection voltage value will be deviated. Further, even in the same type process cartridges B (here, process cartridges having same developer capacity), there is dispersion in PAF value between the process cartridges B.

Although not limited, it is considered that such dispersion in PAF value is caused by dispersion in assembling tolerance of the first and second metal plates 31, 32 (plate antenna) and/or tolerance of other parts of the process cartridge B and electronic elements of the main body 100 of the apparatus.

For example, regarding the electrostatic capacity between the developing roller 5 and the second metal plate 32 (electrode) and the electrostatic capacity between the first and second metal plates 31, 32 (electrodes), their absolute values are varied with positional relationship even when there is no developer, and each value depends upon the positional relationship between the elements so that the value is increased as the element are approached to each other and the value is decreased as the elements are spaced away from each other. In this way, even when the PAF values for various process cartridges are previously set, the value is deviated due to inherent difference of the process cartridge B.

Thus, in the second embodiment, the following control is performed:

(1) The process cartridge B is provided with the memory 20, and the parameter value W corresponding to the developer capacity of the process cartridge B is written in the memory 20.

(2) A minimum value of the detection voltage value (maximum value of electrostatic capacity value), i.e., PAF value is detected by using the developer remaining amount detecting means 30 and the detected value is written in the memory 20 of the process cartridge B. The always detected detection voltage value is compared with the PAPF value previously written in the memory 20 by comparing means of the main body control portion 21. If smaller, the PAF value in the memory 20 is revised, and, if otherwise, the value is nor revised. Such procedures are repeated.

(3) A weighting function using a relationship between the PAF value and the developer remaining amount is previously stored in the main body control portion 21 or in the memory 20 as the calculation formulas 26. The parameter value W is used in this function.

(4) By successively introducing correction values Z of the weighting function into the relationship between the weighting function and the detection voltage value V3, a correction value Z satisfying the relationship is determined.

(5) By using the correction table, the developer remaining amount is calculated.

(6) The result is displayed on the display means at any time.

In this way, even if the detection voltage value (electrostatic capacity value) of the developer capacity (initial loading amount) of the process cartridge B is differentiated or even if there is dispersion in PAF value due to the above-mentioned tolerance, the developer remaining amount can successively be calculated correctly.

Further, explaining the above-mentioned control according to the illustrated embodiment, similar to the first embodiment, also in the second embodiment, when the range until the detection voltage value is increased from the PAF value by the predetermined amount is selected as the developer usable range, the weighting function becomes as follows:

$$F(PAF,\ W,\ Z)=|Z((\alpha-1)PAF+W)+PAF| \quad (1)$$

(where, $\alpha$ and PAF are constant, Z is correction value of weighting function and W is parameter value). Here, in the second embodiment, the PAF value is revised at any time during the image formation.

The constant $\alpha$ is constant previously determined depending upon the fact that the usable range of the developer is selected as a range of how much the detection voltage value is increased from the PAF value. For example, as mentioned above, the usable range can be selected as a range until the developer remaining amount becomes zero (0 g) or a range that the developer remaining amount is decreased to the extent that the white void image is generated not to obtain the image having predetermined image quality.

The parameter value W is a factor for determining the property of the cartridge and is altered in accordance with the developer capacity (initial loading amount) and is previously set.

Further, similar to the first embodiment, the correction value Z is a value dividing the developer usable range with a proper interval and is previously corresponded to the developer amount and is stored in a predetermined storing area of the main body control portion 21 as the remaining amount detection correction table 24 (FIG. 4). The following Table 2 shows an example of the remaining amount detection correction table 24.

TABLE 2

| remaining amount display Y (%) | Z |
|---|---|
| 0 | |
| 0 | |
| 0 | 0.99 |
| 1 | 0.95 |
| 5 | 0.78 |
| 10 | 0.65 |
| 15 | 0.50 |
| 20 | 0.45 |
| 25 | 0.35 |
| 30 | 0.25 |

TABLE 2-continued

| remaining amount display Y (%) | Z |
|---|---|
| 35 | 0.20 |
| 40 | 0.18 |
| 100 | 0.10 |

In the calculating portion 23, the correction values Z are successively introduced into the following formula (2) representing a relationship between the above-mentioned weighting function F (PAF, W, Z) of the above formula (1) and the detection voltage value (V3), thereby obtaining a calculation values:

$$|V3|\geq|Z((\alpha-1)PAF+W)+PAF| \quad (2)$$

The control means 22 determines the correction value Z satisfying the above formula (2) on the basis of the calculation values. The control means 22 recognizes the developer amount from the determined correction value Z by verifying the developer remaining amount detection correction table 24 (calculates the remaining amount display level).

For example, from the remaining amount detection correction table 24 shown in Table 1, when Z=0.10 corresponding to the maximum developer remaining amount is introduced, if the formula (2) is satisfied, it is judged that the developer remaining amount if 100%, and, for example, the fact that the developer remaining amount is 100% is notified. On the other hand, when Z=0.10 is introduced, if the formula (2) is not satisfied, then, Z=0.18 is introduced into the formula (2). In this case, if satisfied, it is judged that the developer remaining amount is 40%, and, the fact that the developer remaining amount is 40% is notified. Namely, if the formula (2) is not satisfied by smaller Z value, the Z value is gradually increased until the formula (2)is satisfied, and, the Z value satisfying the formula (2) is recognized as the developer remaining amount.

Figure 11:
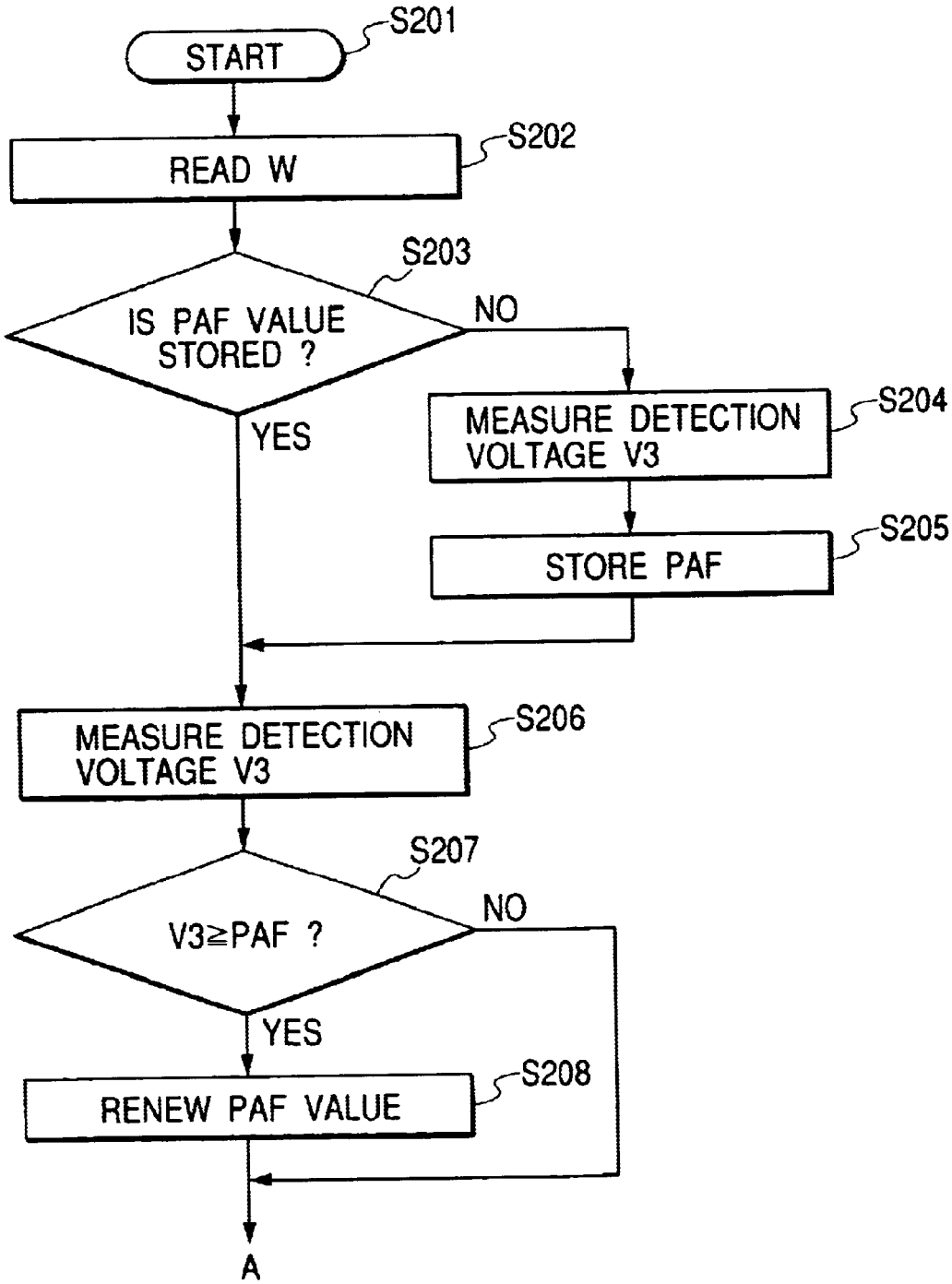
FIG. 11 is a flowchart showing a developer amount detecting operation according to a second embodiment of the present invention.
Figure 12:
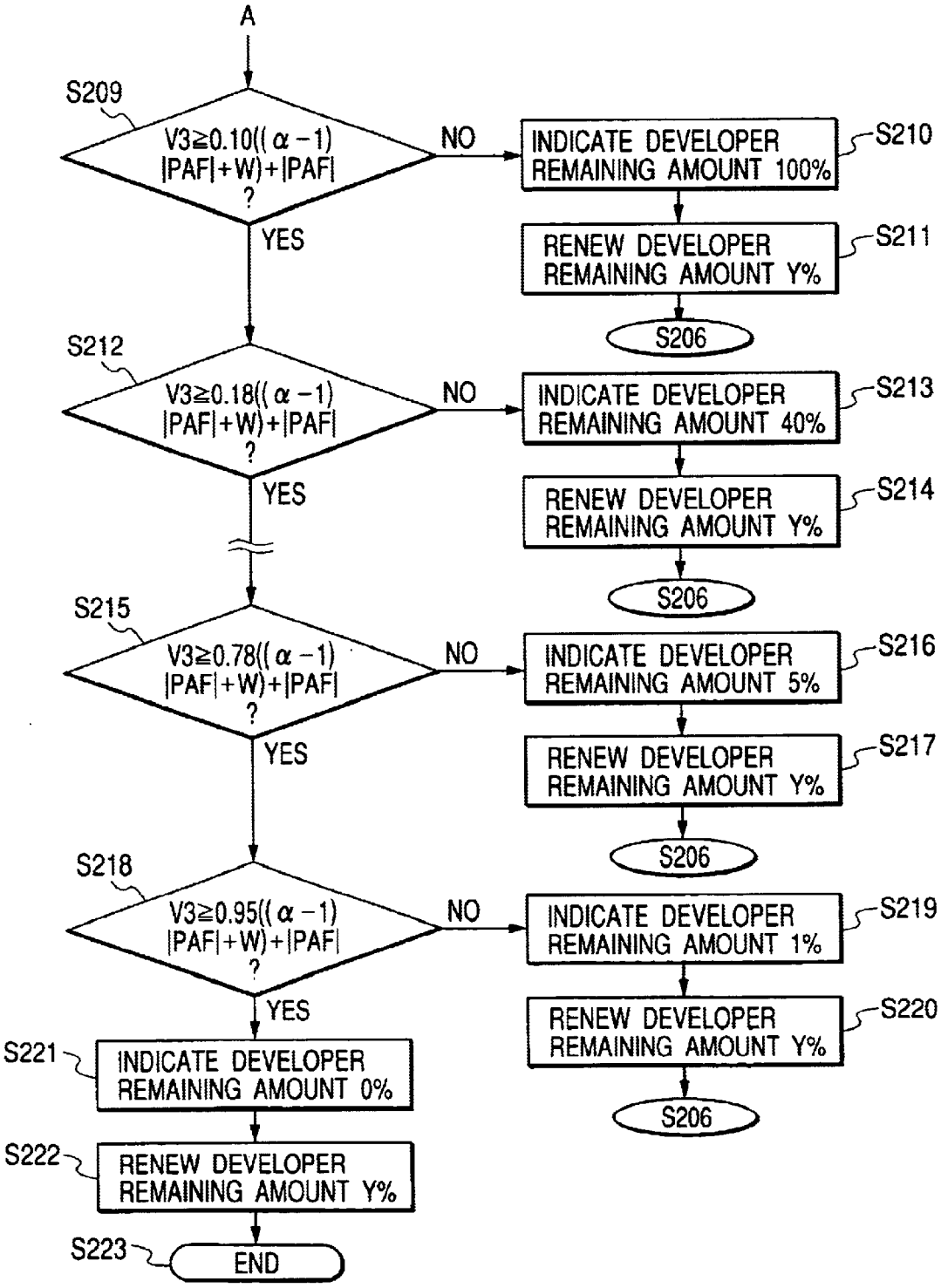
FIG. 12 is a flowchart showing procedures pursuant to FIG. 11.

Next, the successive developer remaining amount detecting operation according to the illustrated embodiment will be explained with reference to a flowchart (steps 1 to 23: S201 to S223) of FIGS. 11 and 12.

S201: A power supply switch of the main body 100 of the apparatus is turned ON to start the operation of the main body 100 of the apparatus (START).

S202: The control means 22 reads out the parameter value W information from the memory 20 of the process cartridge B.

S203: The control means 22 ascertains whether the PAF value is stored in the memory 20 or not. If YES, the program goes to S206. On the other hand, if NO, the detection voltage value V3 is measured (S204), and thereafter, the PAF value is stored in the memory 20 (S205), and the program goes to S206.

S206: The main body side remaining amount detecting portion 25 measures the detection voltage V3.

S207: The control means 22 compares the PAF value stored in the memory 20 with the detection voltage value V3 to ascertain whether the detection voltage value V3 exceeds the PAF value. If YES, the PAF value in the memory is revised (S208) and the program goes to S209. If NO, the program goes to S209.

S209: The calculating portion 23 obtains the calculation value by introducing Z=0.10 o the remaining amount detection correction table 24 into F (PAF, W, Z), and the control means 22 is judges whether V3 exceeds F (PAF, W, Z) or not. If YES, the program goes to S212. On the other hand, if NO, the control means 22 emits a signal notifying the fact that the developer remaining amount is 100% and displays this fact on the display means 40 of the main body 100 of the apparatus (S210). Then, the developer remaining amount Y% value information in the memory 20 is revised (S211), and the program is returned to S206.

S212: The calculating portion 23 obtains the calculation value by introducing Z=0.18 of the remaining amount detection correction table 24 into F (PAF, W, Z), and the control means 22 is judges whether V3 exceeds F (PAF, W, Z) or not. If NO, the control means 22 emits a signal notifying the fact that the developer remaining amount is 40% and displays this fact on the display means 40 of the main body 100 of the apparatus (S213). Then, the developer remaining amount Y% value information in the memory 20 is revised (S214), and the program is returned to S206. On the other hand, if YES, in accordance with the remaining amount detection correction table 24 of Table 2, then, Z=0.20 is introduced. Thereafter, as the above-mentioned flowchart, the procedures are repeated until Z=0.95. Incidentally, explanation of such repetition will be omitted.

S215: The calculating portion 23 obtains the calculation value by introducing Z=0.78 of the remaining amount detection correction table 24 into F (PAF, W, Z), and the control means 22 is judges whether V3 exceeds F (PAF, W, Z) or not. If NO, the control means 22 emits a signal notifying the fact that the developer remaining amount is 5% and displays this fact on the display means 40 of the main body 100 of the apparatus (S216). Then, the developer remaining amount Y% value information in the memory 20 is revised (S217), and the program is returned to S206. On the other hand, if YES, the program goes to S218.

S218; The calculating portion 23 obtains the calculation value by introducing Z=0.95 of the remaining amount detection correction table 24 into F (PAP, W, Z), and the control means 22 is judges whether V3 exceeds F (PAF, W, Z) or not. If NO, the control means 22 emits a signal notifying the fact that the developer remaining amount is 1% and displays this fact on the display means 40 of the main body 100 of the apparatus (S219). Then, the developer remaining amount Y% value information in the memory 20 is revised (S220), and the program is returned to S206. On the other hand, if YES, the program goes to S221.

S221: The control means 22 emits information notifying the fact that the developer remaining amount is 0% or that the process cartridge should be exchanged and displays this fact on the display means 40 of the main body 100 of the apparatus.

S222: The developer remaining amount Y% value information in the memory 20 is revised.

S223: The program is ended.

Figure 13:
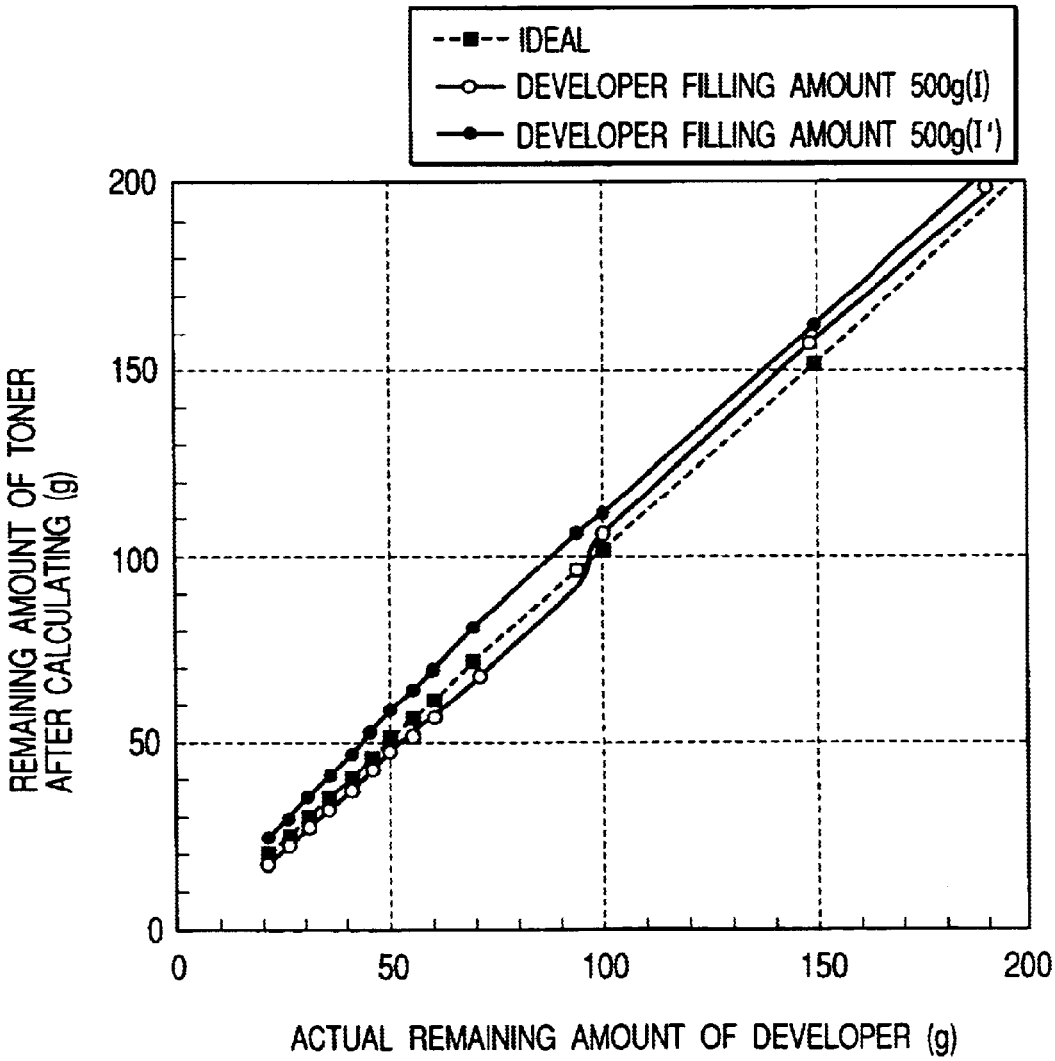
FIG. 13 is a graph showing a relationship between calculated developer amount values obtained by calculation in the second embodiment and actual developer amounts.

Regarding the process cartridges B having different developer capacities (initial loading amounts), the developer amounts (g) actually remaining in the developing apparatus C and the developer remaining amounts (g) sought by the calculating processing by effecting the control according to the above-mentioned flowchart were compared and evaluated. As a result, the difference in developer capacity between the cartridges and the inherent difference of the process cartridge were absorbed and the developer remaining amount could successively be detected with high accuracy. FIG. 13 shows a relationship between the actual developer remaining amount and the developer remaining amount sought by the calculating processing, regarding the process cartridges B1 having developer capacity of 500 g. Similar results can be obtained, for example, in the process cartridge B2 having developer capacity of 300 g.

From this fact, for example, after the process cartridge B1 was bought, even when the process cartridge B2 having different developer capacity is newly added, the developer remaining amount can be detected successively and correctly by revising the parameter value W stored in the memory 20.

As mentioned above, according to the second embodiment, the deviation of transition of electrostatic capacity detection value (detection voltage value) caused due to cartridge property such as the type of the cartridge (developer capacity (initial loading amount)) or inherent difference of the cartridge can be eliminated and the developer amount for each cartridge can always be calculated correctly.

Third Embodiment

Next, the process cartridge used in a third embodiment of the present invention will be explained.

Figure 17:
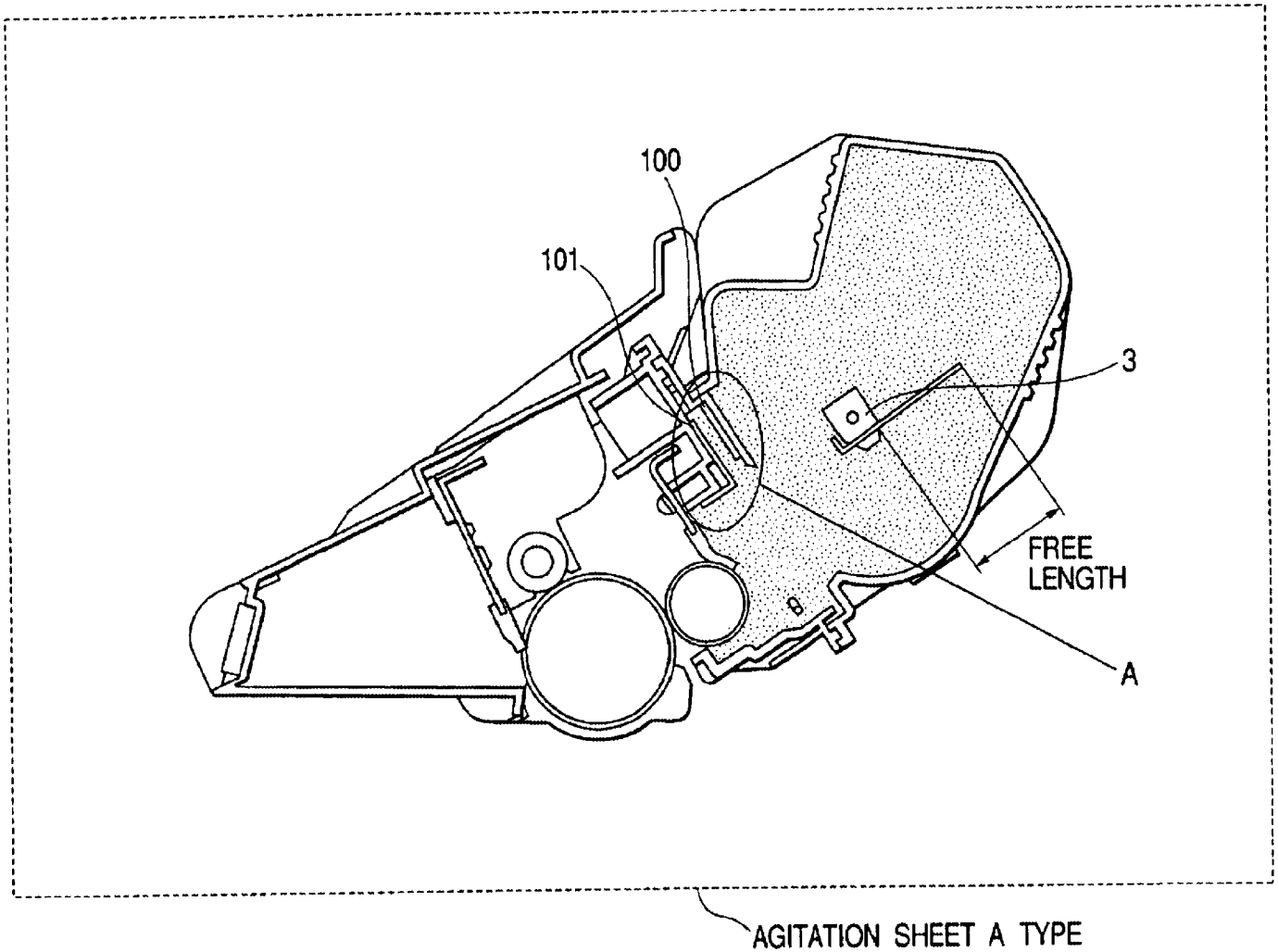
FIG. 17 is a sectional view of a process cartridge using an A type agitating sheet.
Figure 18:
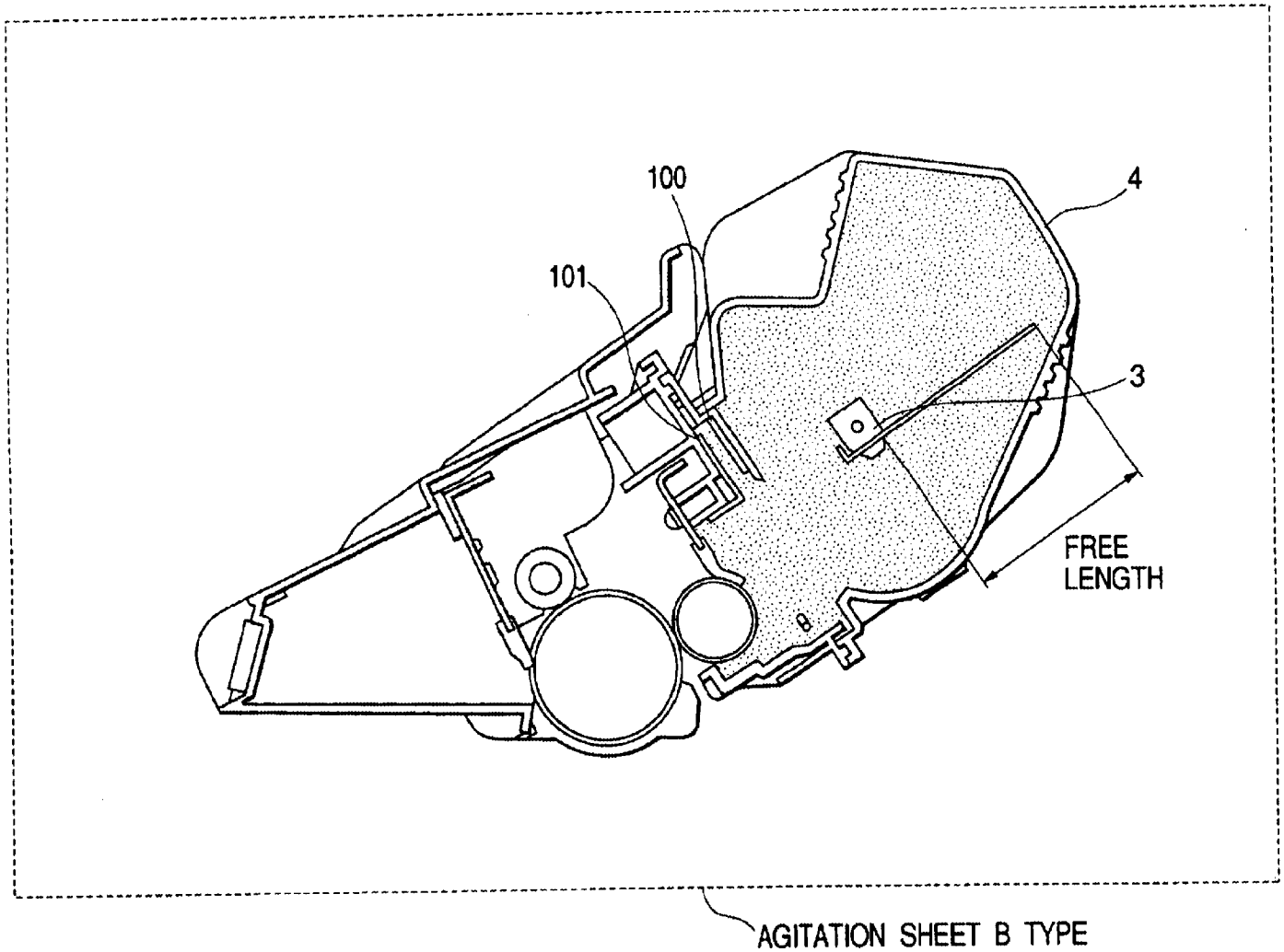
FIG. 18 is a sectional view of a process cartridge using a B type agitating sheet having a free length greater than that of the A type.

FIGS. 17 and 18 show cartridges to be mounted to the main body of the image forming apparatus and having different cartridge constructions. As can be seen from these Figures, the positional relationships of the plate antennas in the respective cartridges are the same, and lengths of sheet portions of agitating members 3 are different from each other.

Figure 19:
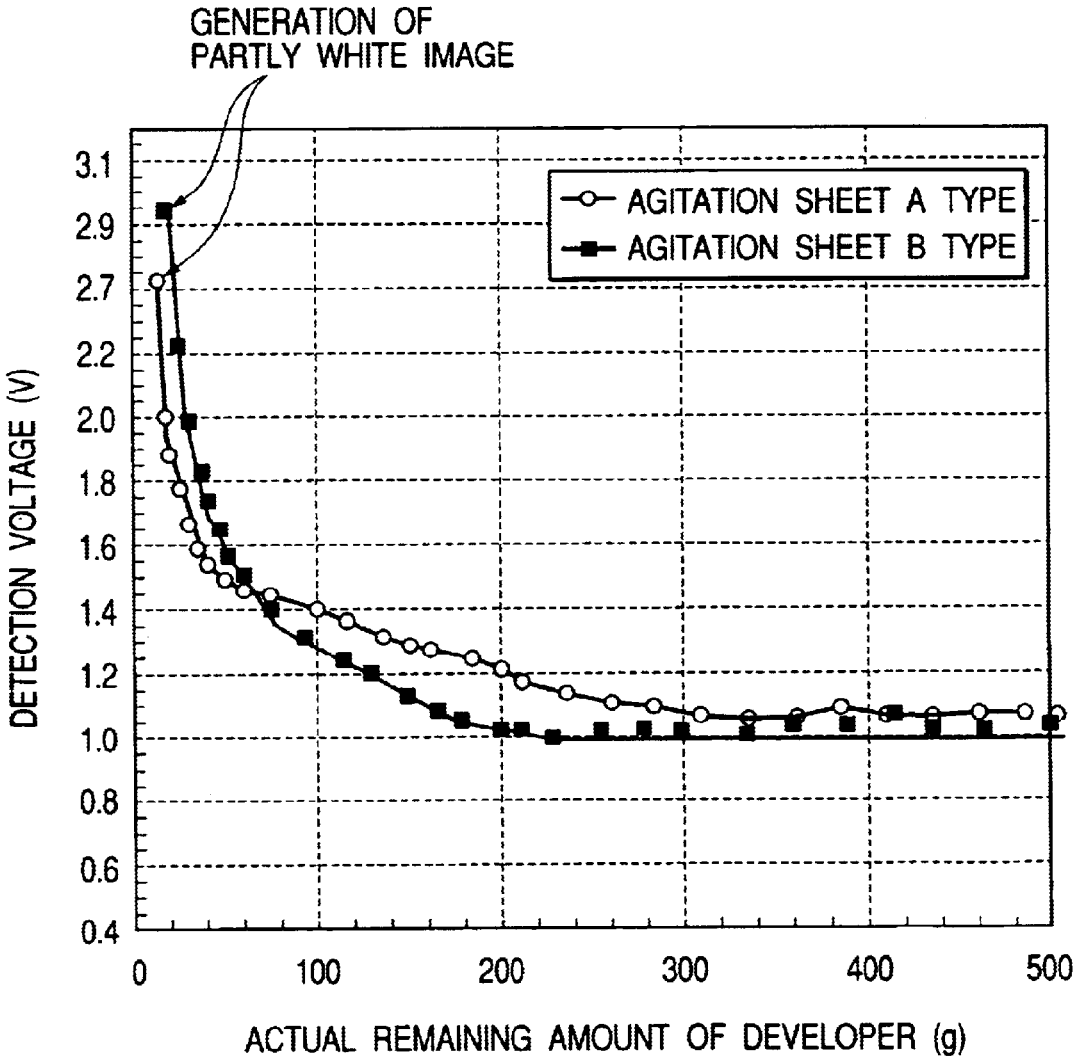
FIG. 19 is a graph showing a relationship between actual developer remaining amounts of cartridges having different type agitating sheets and detection voltage.

FIG. 19 shows results obtained by mounting the respective cartridges according to the illustrated embodiment to the image forming apparatus and by measuring the relationships between the toner amounts and the detection voltage values. From FIG. 19, it can be seen that the relationships between the toner amounts and the detection voltage values of the respective cartridges do not coincide with each other.

The reason is that a toner circulating system within the developer container is greatly differentiated due to difference in agitation, and transition of toner at an area (area A in FIG. 17) of the plate antenna detecting portion greatly affecting an influence upon the value of the developer remaining detecting means is differentiated. Thus, difference in output transition occurs.

In order to correct such difference, parameter values W (data regarding the remaining amount of developer remaining in the container when the white void image is generated) corresponding to types of the agitating members must be included in the calculation formula thereby to correct the output transition. The value W is varied with the type of the agitating member. The longer the free length of the agitating sheet the smaller the value W.

Thus, in the illustrated embodiment, the following control is performed:

(1) The process cartridge is provided with a memory, and a minimum value of the detection voltage value (maximum value of electrostatic capacity value), i.e., PAF value and the parameter value W corresponding to the cartridge construction are written in the memory.

(2) A formula representing a relationship between the PAF value and the detection voltage value upon no developer is previously stored in the main body control portion. The parameter value W corresponding to the cartridge construction stored in the memory is used in this function. A developer remaining amount dividing value is corrected by thus parameter value.

(3) A weighting function using a relationship between the PAF value and the developer remaining amount is previously stored in the main body control portion 21.

(4) The detection voltage values are successively introduced into the weighting function.

(5) By using the correction table, the developer remaining amount is calculated.

(6) The result is displayed on the display means at any time.

In this way, even if the transition of the developer remaining amount in the cartridge construction is differentiated, the developer remaining amount can successively be calculated correctly.

In this control method, when a range from the PAF value to the developer remaining amount of 0 g is selected as the usable range, the weighting function is represented as follows:

$$F(PAF, W, Z)=|Z((\alpha-1)PAF+W)+PAF| \quad (1)$$

where, $\alpha$ and PAF are constant, Z is correction value and W is parameter value.

The value Z is a value dividing the developer usable range with a proper interval and is previously stored in the main body control portion as the remaining amount detection correction table. Incidentally, the following Table 3 shows the remaining amount detection correction table.

TABLE 3

| developer remaining amount as to 500 g initial amount (g) | remaining amount display Y (%) | Z |
|---|---|---|
| 20 | 0 | |
| 20 | 0 | |
| 20 | 0 | 0.99 |
| 25 | 1 | 0.95 |
| 45 | 5 | 0.78 |
| 70 | 10 | 0.65 |
| 95 | 15 | 0.50 |
| 120 | 20 | 0.45 |
| 145 | 25 | 0.35 |
| 170 | 30 | 0.25 |
| 195 | 35 | 0.20 |
| 220 | 40 | 0.18 |
| 500 | 100 | 0.10 |

The developer remaining amount is sought by the correction value satisfying the following relationship:

$$|V3| \geqq |Z((\alpha-1)PAF+W)+PAF| \quad (2)$$

From the successive detection correction table shown by Table 3, if Z=0.10 satisfied he above relationship (2), the developer remaining amount is displayed as 100%; thereas, if Z=0.10 does not satisfy the above relationship (2), then, Z=0.18 is introduced into the above relationship (2). In this case, if the relationship is satisfied, the developer remaining amount becomes 40%. Namely, if the relationship (2) is not satisfied by smaller Z value, the Z value is gradually increased until the relationship (2) is satisfied, and, the Z value satisfying the relationship (2) is recognized as the developer remaining amount.

Figure 20:
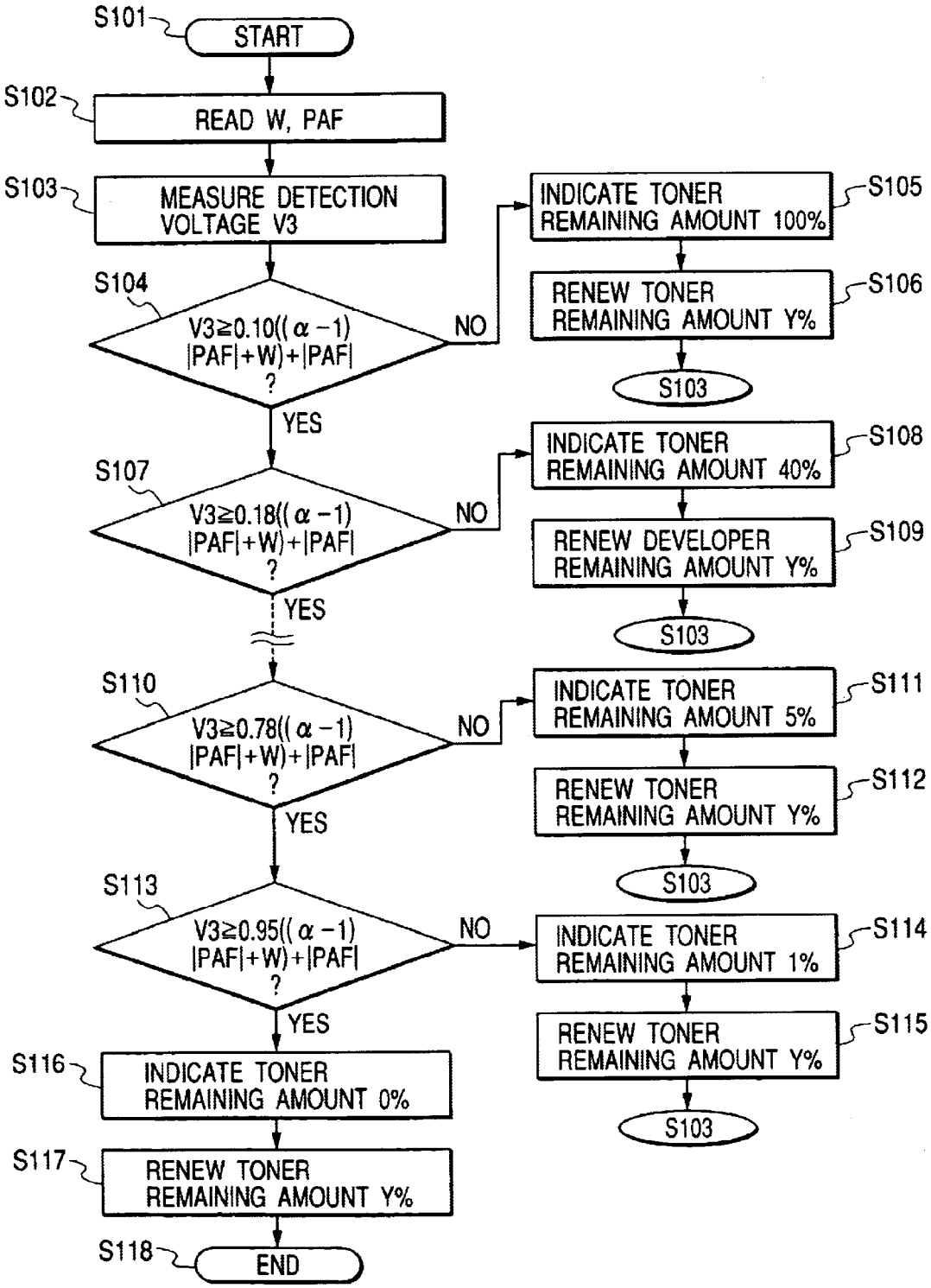
FIG. 20 is a flowchart showing a developer amount calculating sequence according to a third embodiment.

Next, the successive developer remaining amount detecting operation will be explained with reference to a flowchart (steps 101 to 118: S101 to S118) of FIG. 20.

S101: A power supply switch is turned ON to start the operation of the main body of the image forming apparatus (START).

S102: The control means 22 reads out the parameter value W information and the PAF value from the memory 20.

S103: The main body side remaining amount detecting portion 25 measures the detection voltage V3.

S104: The calculating portion 23 obtains the calculation value by introducing Z=0.10 of the remaining amount detection correction table into F (PAF, W, Z), and the control means 22 judges whether V3 exceeds F (PAF, W, Z) or not. If YES, the program goes to S107. On the other hand, if NO, the program goes to S105, and the control means 22 emits a signal notifying the fact that the developer remaining amount is 100% to the interior of an engine and displays this fact on the display means. Then, the program goes to S106, and the developer remaining amount Y% value information in the memory 20 is revised, and the program is returned to S103.

S107: The calculating portion 23 obtains the calculation value by introducing Z=0.18 of the remaining amount detection correction table into F (PAF, W, Z), and the control means 22 is judges whether V3 exceeds F (PAF, W, Z) or not. If NO, the program goes to S108 and the control means 22 emits a signal notifying the fact that the developer remaining amount is 40% to the interior of the engine and displays this fact on the display means. Then, the program goes to S109, and the developer remaining amount Y% value information in the memory 20 is revised, and the program is returned to S103.

On the other hand, if YES, in accordance with the remaining amount detection correction table of Table 3, then, Z=0.20 is introduced. Thereafter, as the above-mentioned flowchart the procedures are repeated until Z=0.95.

S110: The calculating portion 23 obtains the calculation value by introducing Z=0.78 of the remaining amount detection correction table into F (PAF, W, Z), and the control means 22 is judges whether V3 exceeds F (PAF, W, Z) or not. If NO, the program goes to S111 and the control means 22 emits a signal notifying the fact that the developer remaining amount is 5% to the interior of the engine and displays this fact on the display means. Then, the program goes to S112 and the developer remaining amount Y% value information in the memory 20 is revised, and the program is returned to S103. On the other hand, if YES, the program goes to S113.

S113: The calculating portion 23 obtains the calculation value by introducing Z=0.95 of the remaining amount detection correction table into F (PAF, W, Z), and the control means 22 is judges whether V3 exceeds F (PAF, W, Z) or not. If NO, the program goes to S114 and the control means 22 emits a signal notifying the fact that the developer remaining amount is 1% to the interior of the engine and displays this fact on the display means. Then, the program goes to S115 and the developer remaining amount Y% value information in the memory 20 is revised, and the program is returned to S103. On the other hand, if YES, the program goes to S116.

S116: The control means 22 emits information notifying the fact that the developer remaining amount is 0% to the interior of the engine and displays this fact on the display means.

S117: The developer remaining amount Y% value information in the memory 20 is revised.

S118: The program is ended.

Since the longer the free length of the agitating sheet the smaller the W value, when the cartridge using the agitating sheet of B type is mounted to the main body of the apparatus, display regarding the remaining amount % or request for exchange of the cartridge is effected at a point that the detection remaining amount of the remaining amount detecting antenna is much more than that when the cartridge using the agitating sheet of A type is mounted.

Figure 21:
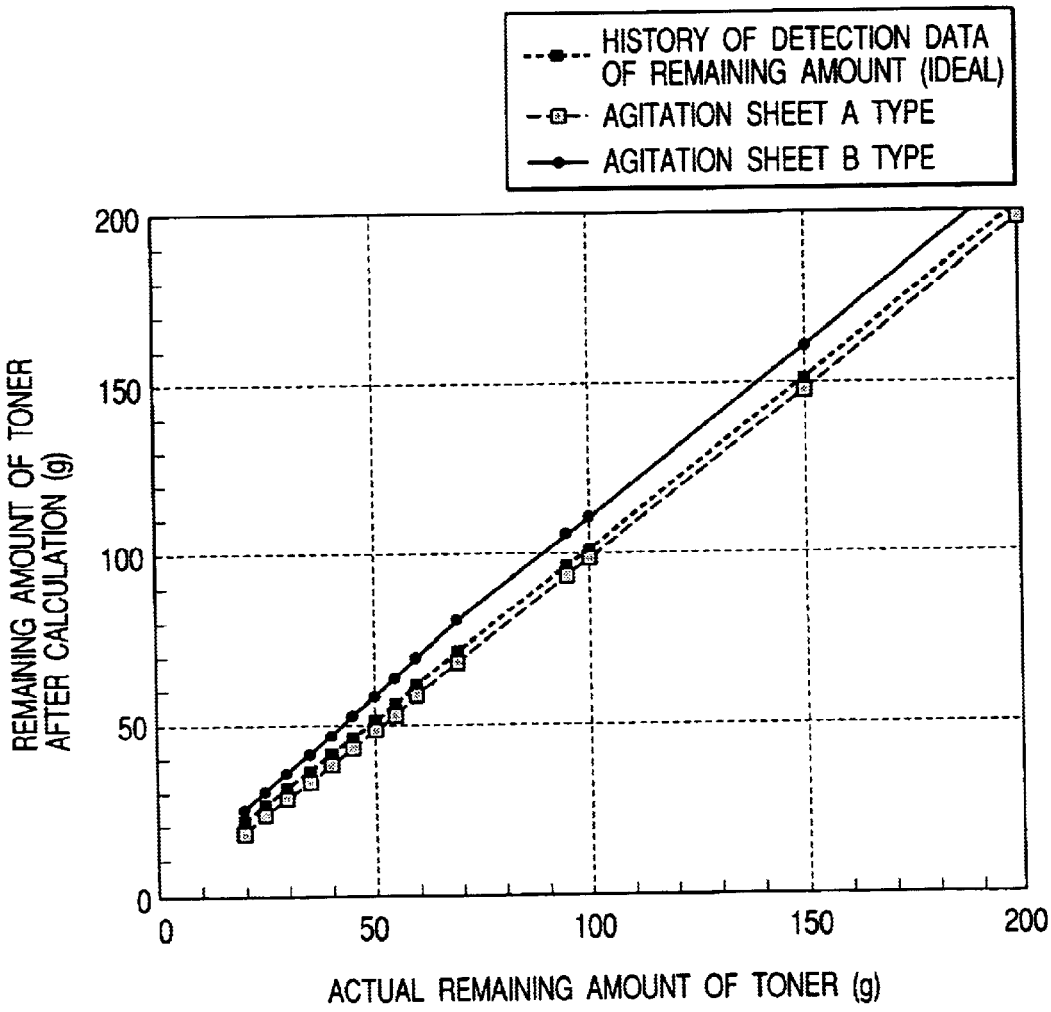
FIG. 21 is a graph showing a relationship between developer amount values calculated in the third embodiment and actual developer amounts.

By performing the operation in accordance with the above flowchart, as shown in FIG. 21, the successive developer remaining amount detection can be performed while absorbing the developer construction difference of the cartridge. From this fact, after the process cartridge using the agitating sheet of A type was bought, even when the process cartridge using the agitating sheet of B type is newly added, the developer remaining amount can be detected successively and correctly by revising the parameter value W stored in the memory.

Naturally, since the relationship between the developer remaining amount and the detection voltage value is greatly changed in accordance with the cartridge construction, particularly, construction and arrangement of the developer remaining amount detecting means, the parameter values are not limited to the values according to the illustrated embodiment, but they are independently set to match with the embodiments. To this end, the parameter values may be based on not only the type of the agitating member but also kind of developer and the manufacturing condition of the cartridge.

Further, in the illustrated embodiment, while an example that dividing interval of about 5 g (5%) is used was explained, of course, the finer the interval, the finer developer remaining amount display can be made. Further, also regarding the resolving power, not only the uniform interval may be adopted, but also the interval at the fewer remaining amount may be made narrower, such as 100%, 30%, 20%, 15%, 10%, 8%, 5%, The displaying style of the developer remaining amount is not limited to (g) or (%), but, other displaying style such as "last XXX sheets can be outputted" may be used.

Further, regarding the display, any means such as gas gauge, pole graph, value display or ratio to full (i.e., remaining %), so long as the operator can recognize the developer remaining amount. In the illustrated embodiment, while an example that the plate antenna system is used as the developer remaining amount level detecting means was explained, the present invention is not limited to such developer remaining amount level detecting means, but any system may be used so long as the developer remaining amount level can be detected.

Fourth Embodiment

Next, a fourth embodiment of the present invention will be explained. In the fourth embodiment, since a construction of an image forming apparatus is the same as those in the first to third embodiments, explanation thereof will be omitted, and only feature of the fourth embodiment will be described.

In the third embodiment, while the cartridges using the different type agitating sheets were explained, in the fourth embodiment, cartridges having different capacities and different configurations will be described. This aims to effect more correct successive remaining amount detection while absorbing difference in the type of the cartridge.

As the memory used in the present invention, an electronic memory of semiconductor can particularly be used without any limitation. Particularly, in case of a memory of noncontact type for effecting data communication between the memory 20 and a read/write IC via an electromagnetic wave, since a transmitting portion 23 may not be contacted with the main body control portion 24, there is no danger of causing poor contact due to poor mounting of the process cartridge B, thereby permitting control with high reliability.

Control means for effecting read/write of information with respect to the memory is constituted by these two control portions. The memory may have capacity sufficient to store a plurality of information data such as use amount of the cartridge and cartridge property value, which will be described later. Further, the used amount of the cartridge is written and stored in the memory 20 at any time.

Incidentally, since the memory control arrangement according to the illustrated is the same as that in the first embodiment, explanation thereof will be omitted here.

Next, the construction of the process cartridge will be described.

Figure 22:
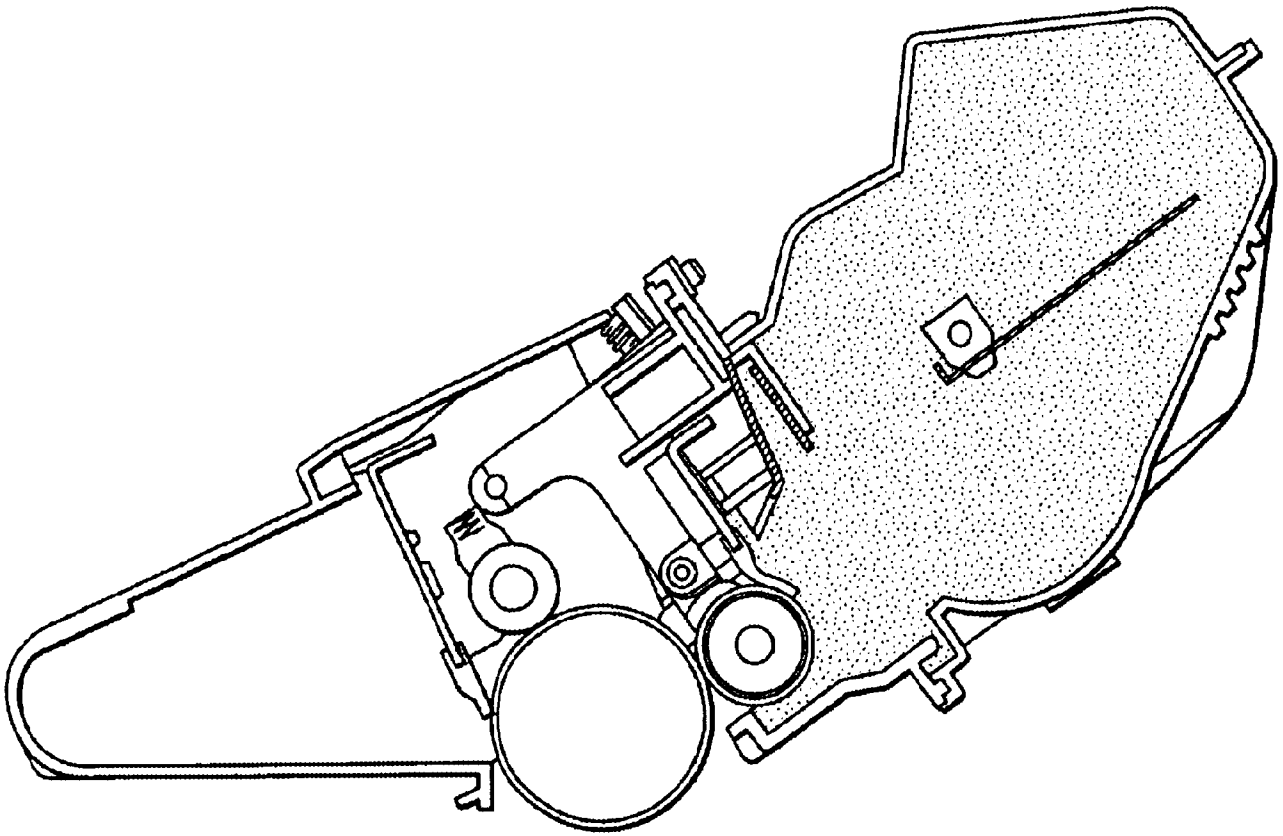
FIG. 22 is a sectional view of a cartridge having toner loading amount of 300 g.
Figure 23:
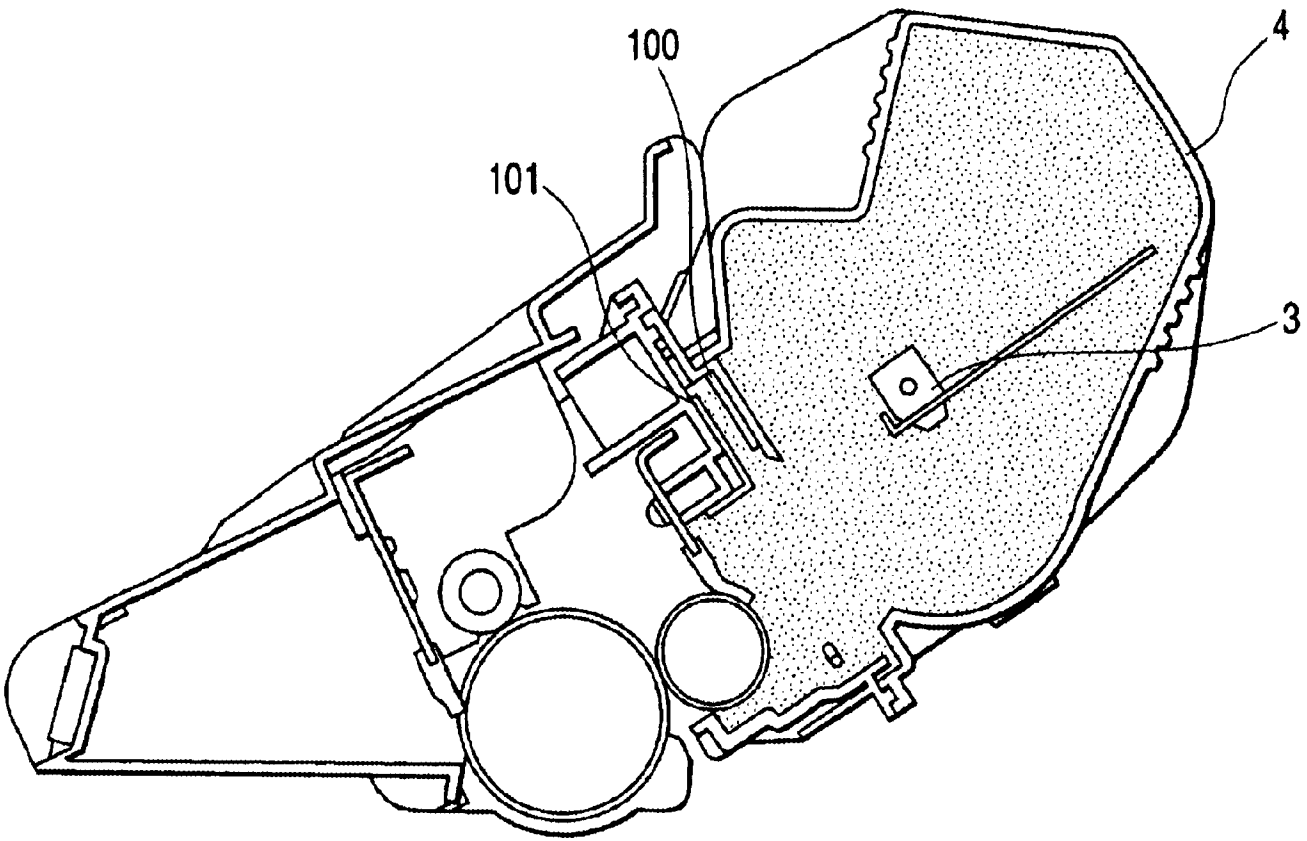
FIG. 23 is a sectional view of a cartridge having toner loading amount of 500 g and having a configuration of a toner container slightly different from that of the cartridge of FIG. 22.

The process cartridges according to the illustrated embodiment are shown in FIGS. 22 and 23. FIG. 22 shows a cartridge having developer loading amount of 300 g and capable of printing 6000 sheets, and FIG. 23 shows a cartridge having developer loading amount of 500 g and capable of printing 10000 sheets. Although cartridge configurations are slightly different from each other in dependence upon the difference in capacity, internal constructions are the same. These two cartridges can be mounted to the same main body of the image forming apparatus.

Next, the successive remaining amount detection will be explained.

Figure 24:
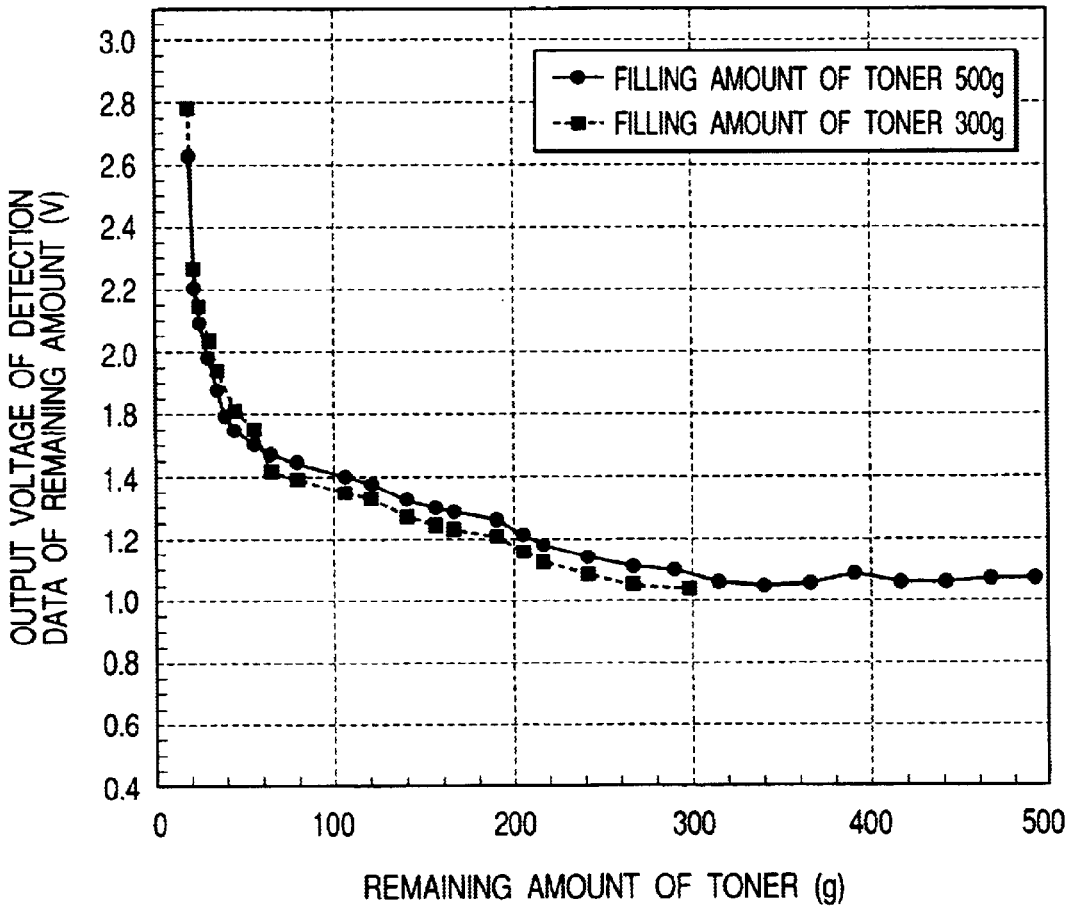
FIG. 24 is a graph showing a relationship between actual developer remaining amounts and detection voltage, regarding a case where image output is effected by using the cartridge of FIG. 22 and a case where image output is effected by using the cartridge of FIG. 23.

In the illustrated embodiment, the electrostatic capacity value detected by the developer remaining amount detecting means is converted into voltage by the main body of the image forming apparatus, and the control is effected with the voltage value. The voltage value is the detection voltage value which is the sum of an electrostatic capacity value measured between plate antennas 100, 101 and an electrostatic capacity value measured between the plate antenna 100 and a developing roller 2. When the developer amount is maximum, the detection voltage value indicates the minimum PAF value (electrostatic capacity is maximum). The PAF value is written in the memory in a condition that the loading of the developer is completed, and, when the detection voltage value becomes minimum (electrostatic capacity is maximum) during the operation of the laser beam printer, the PAF value is revised accordingly. FIG. 24 shows a relationship between the developer remaining amount and the detection voltage value, regarding the process cartridges having different developer capacities and different configurations. As can be seen from FIG. 24, if the developer capacity is changed, the volume density of the developer is also changed due to own weight of the developer, and, if the configuration is changed, the flow of developer circulation is changed to change the remaining amount detection transition.

Thus, in the illustrated embodiment, the following control is performed:

(1) The process cartridge is provided with a memory, and parameter values corresponding to the cartridge capacity and cartridge configuration are written in the memory.

(2) The minimum value of the detection voltage value, i.e., PAF value (maximum value of electrostatic capacity value) obtained from the remaining amount detecting means is stored in the memory of the process cartridge.

(3) A weighting function using a relationship between the PAF value and the developer remaining amount is previously stored in the main body control portion. The parameter value is used in this function.

(4) The detection voltage values are introduced into the weighting function.

(5) By using the correction table, the developer remaining amount is calculated.

(6) The result is displayed on the display means at any time.

In this way, even if the cartridge capacity and/or the cartridge configuration is differentiated, the developer remaining amount can successively be calculated correctly.

In this control method, when the range from the PAF value to the developer remaining amount of 0 g is selected to the usable range, the weighting function becomes as follows:

$$F(PAF, W, Z)=|Z((\alpha-1)PAF+W)+PAF| \quad (1)$$

(where, α is constant, Z is correction value and W is parameter value).

The correction value Z is a value dividing the developer usable range with a proper interval and is previously stored in the main body control portion as the remaining amount detection correction table. Incidentally, the following Table 4 shows the remaining amount detection correction table.

TABLE 4

| remaining amount display Y (%) | Z |
|---|---|
| 0 | |
| 0 | |
| 0 | 0.99 |
| 1 | 0.95 |
| 5 | 0.78 |
| 10 | 0.65 |
| 15 | 0.50 |
| 20 | 0.45 |
| 25 | 0.35 |
| 30 | 0.25 |
| 35 | 0.20 |
| 40 | 0.18 |
| 100 | 0.10 |

The developer remaining amount is sought by the correction value Z satisfying the following relationship (2):

$$|V3| \geqq |Z((\alpha-1)PAF+W)+PAF| \quad (2)$$

From the successive detection correction table shown by Table 4, if Z=0.10 satisfies the above relationship (2), the developer remaining amount is displayed as 100%, whereas, if Z=0.10 does not satisfy the above relationship (2), then, Z=0.18 is introduced into the above relationship (2). In this case, if the relationship is satisfied, the developer remaining amount becomes 40%. Namely, if the relationship (2) is not satisfied by smaller Z value, the Z value is gradually increased until the relationship (2) is satisfied, and, the Z value satisfying the relationship (2) is recognized as the developer remaining amount.

Figure 25:
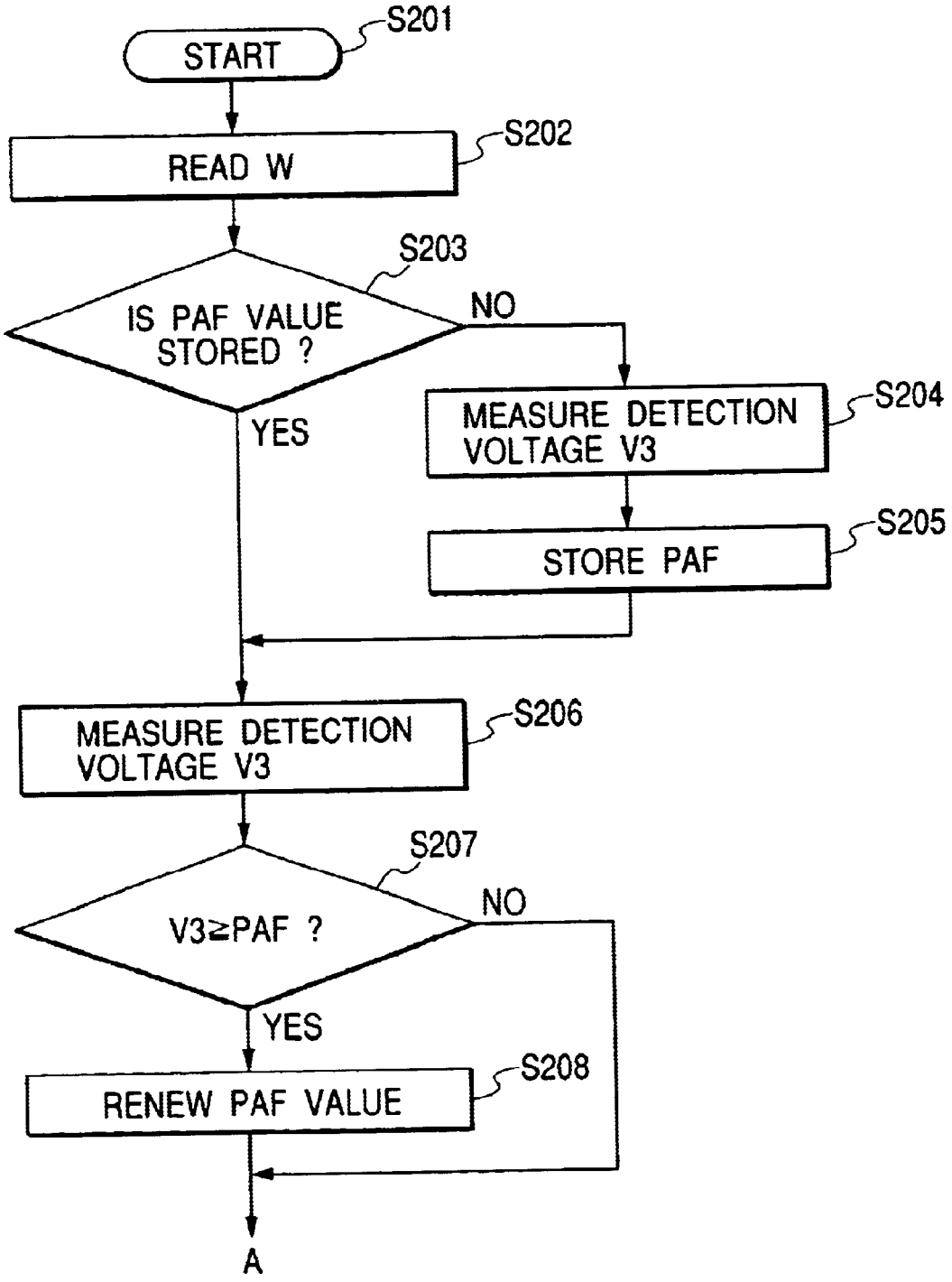
FIG. 25 is a flowchart showing a developer amount calculating sequence according to a fourth embodiment.
Figure 26:
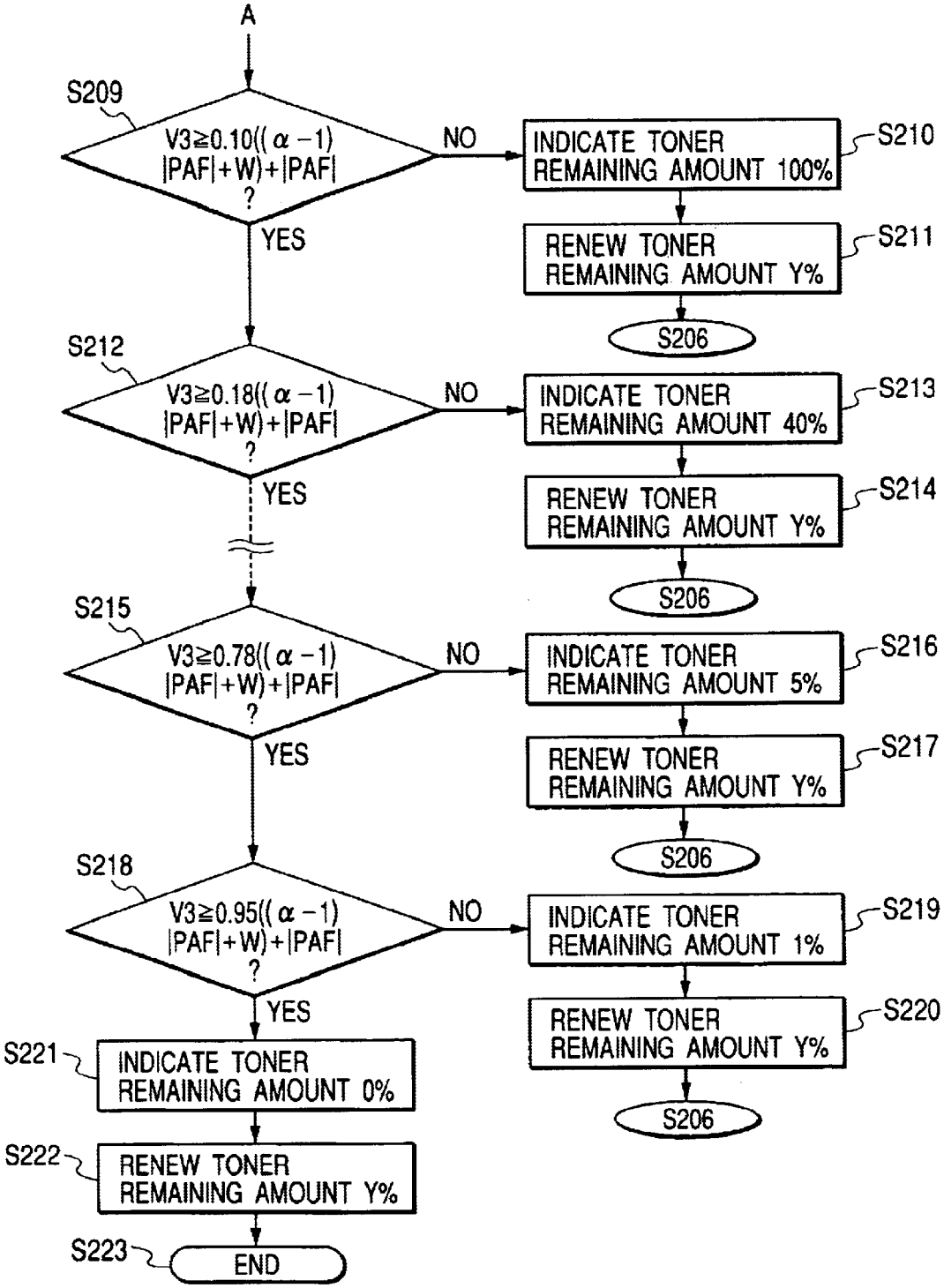
FIG. 26 is a flowchart showing a developer amount calculating sequence according to the fourth embodiment.

Next, the successive developer remaining amount detecting operation according to the illustrated embodiment will be explained with reference to flowcharts of FIGS. 25 and 26 (steps 201 to 223: S201 to S223.

S201: A power supply switch is turned ON to start the operation of the main body of the apparatus (START).

S202: The control means 22 reads out the parameter value W information from the memory 20.

S203: The control means 22 ascertains whether the PAF value is stored in the memory 20 or not. If YES, the program goes to S206.

On the other hand, if NO, the program goes to S204 and the detection voltage value is measured, and thereafter, the PAF value is stored in the memory 20 (S205), and the program goes to S206.

S206: The remaining amount detecting portion 25 measures the detection voltage V3.

S207: The control means 22 compares the PAF value stored in the memory 20 with the detection voltage value V3 to ascertain whether the detection voltage value V3 exceeds the PAF value. If YES, the program goes to S208 and the PAF value in the memory 20 is revised and the program goes to S209. If NO, the program goes to S209.

S209: The calculating portion 23 obtains the calculation value by introducing Z=0.10 of the remaining amount detection correction table into F (PAF, W, Z), and the control means 22 is judges whether V3 exceeds F (PAP, W, Z) or not. If YES, the program goes to S212. On the other hand, if NO, the program goes to S201 and the control means 22 emits a signal notifying the fact that the developer remaining amount is 100% to the interior of an engine and displays this fact on the display means. Thus, the program goes to S211 and the developer remaining amount Y% value information in the memory 20 is revised, and the program is returned to S206.

S212: The calculating portion 23 obtains the calculation value by introducing Z=0.18 of the remaining amount detection correction table into F (PAF. W, Z), and the control means 22 is judges whether V3 exceeds F (PAF, W, Z) or not. If NO, the program goes to S213 and the control means 22 emits a signal notifying the fact that the developer remaining amount is 40% to the interior of the engine and displays this fact on the display means. Then, the program goes to S214 and the developer remaining amount Y% value information in the memory 20 is revised, and the program is returned to S206.

On the other hand, if YES, in accordance with the remaining amount detection correction table of the table 4, then, Z=0.20 is introduced. Thereafter, the procedures are repeated till Z=0.95.

S215: The calculating portion 23 obtains the calculation value by introducing Z=0.78 of the remaining amount detection correction table into F (PAF, W, Z), and the control means 22 is judges whether V3 exceeds F (PAF, W, Z) or not. If NO, the program goes to S216 and the control means 22 emits a signal notifying the fact that the developer remaining amount is 5% to the Interior of the engine and displays this fact on the display means. Then, the program goes to S217 and the developer remaining amount Y% value information in the memory 20 is revised, and the program is returned to S206. On the other hand, if YES, the program goes to S218.

S218: The calculating portion 23 obtains the calculation value by introducing Z=0.95 of the remaining amount detection correction table into F (PAP, W, Z), and the control means 22 is judges whether V3 exceeds F (PAF, W, Z) or not. If NO, the program goes to S219 and the control means 22 emits a signal notifying the fact that the developer remaining amount is 1% to the interior of the engine and displays this fact on the display means. Then, the program goes to S220 and the developer remaining amount Y% value information in the memory 20 is revised, and the program is returned to S206. On the other hand, if YES, the program goes to S221.

S221: The control means 22 emits information notifying the fact that the developer remaining amount is 0% to the interior of the engine and displays this fact on the display means.

S222: The developer remaining amount Y% value information in the memory 20 is revised.

S223: The program is ended.

Figure 27:
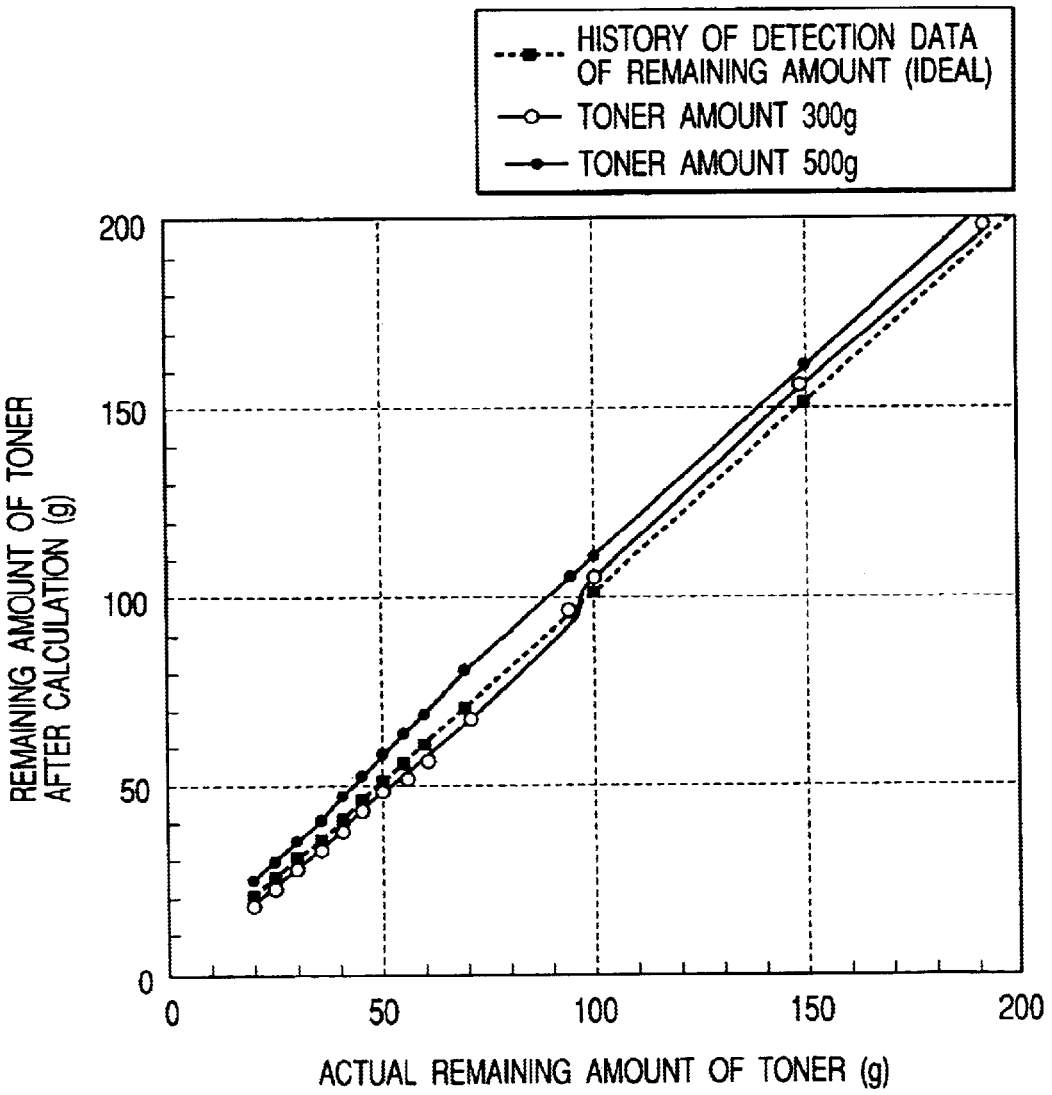
FIG. 27 is a graph showing a relationship between developer amount values calculated in the fourth embodiment and actual developer amounts.

By effecting the operation in accordance with the above-mentioned flow chart, as shown in FIG. 27, the successive remaining amount detection can be made while absorbing the difference in developer capacity of the cartridge and inherent difference of the cartridge.

Naturally, since the relationship between the developer remaining amount and the detection voltage value is greatly changed in accordance with the cartridge construction, particularly, construction and arrangement of the developer remaining amount detecting means, the parameter values are not limited to the values according to the illustrated embodiment, but they are independently set to match with the embodiments.

Further, in the illustrated embodiment, while an example that dividing interval of about 5 g (5%) is used was explained, of course, the finer the interval, the finer developer remaining amount display can be made. Further, also regarding the resolving power, not only the uniform interval may be adopted, but also the interval at the fewer remaining amount may be made narrower, such as 100%, 30%, 20%, 15%, 10%, 8%, 5%, . . . the displaying style of the developer remaining amount is not limited to (g) or (%), but, other displaying style such as "last XXX sheets can be outputted" may be used.

Further, regarding the display, any means such as gas gauge, pole graph, value display or ratio to full (i.e., remaining %), so long as the operator can recognize the developer remaining amount. In the illustrated embodiment, while an example that the plate antenna system is used as the developer remaining amount level detecting means was explained, the present invention is not limited to such developer remaining amount level detecting means, but any system may be used so long as the developer remaining amount level can be detected.

Fifth Embodiment

Figure 14:
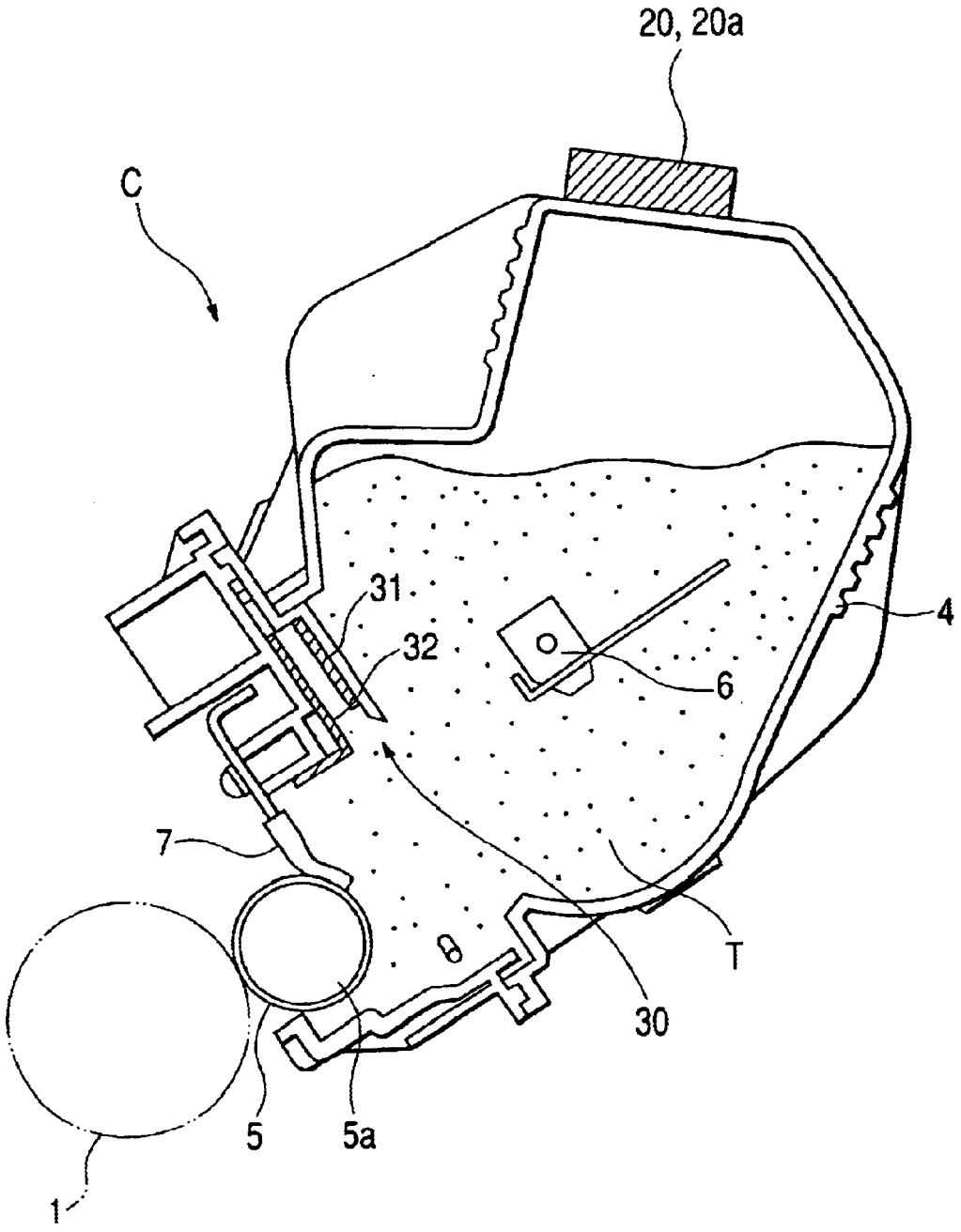
FIG. 14 is a schematic sectional view showing an example of a developing apparatus constituted as a cartridge according to a fifth embodiment of the present invention.

FIG. 14 shows an embodiment of a developing apparatus C constituted as a cartridge, according to a further embodiment of the present invention.

The developing apparatus C according to this embodiment is formed as a cartridge by integrally forming a developing roller 5 and a developer containing container 4 by means of a plastic developer frame. Namely, in the developing apparatus C according to the illustrated embodiment, constructural parts of the developing apparatus of the process cartridge B is constituted as a unit, that is to say, it can be considered as an integral cartridge except for the photosensitive drum 1, electrifying means 2 and cleaning means 8 removed from the process cartridge B. Accordingly, all of the constructions of the developing apparatus and the developer amount detecting device explained in connection with the first to fourth embodiments can similarly be applied to the developing apparatus C of the fifth embodiment. Accordingly, since the construction and the function are the same as those described in connection with the first to fourth embodiments, explanation thereof will be omitted.

However, in this embodiment, a difference is that the memory 20 is attached to the developer containing container 4.

Also with the arrangement of this embodiment, technical effects same as those in the first to fourth embodiments can be achieved.

In this way, several embodiments of the present invention were explained.

Incidentally, of course, since the relationship between the developer remaining amount and the detection voltage value is greatly varied with the cartridge construction, particularly with the construction and arrangement of the developer remaining amount detecting means 30 the developer remaining amount correction tables are not limited to the tables 1 to 4, but may appropriately be determined in accordance with properties of the image forming apparatus and the cartridge to which the present invention is applied.

Similarly, since the relationship between the developer remaining amount and the detection voltage value is greatly varied with the cartridge construction, particularly with the construction and arrangement of the developer remaining amount detecting means 30, the present invention does not particularly limit the above-mentioned parameter values W, but the parameter values may be independently set to match with the embodiments.

Further, in the above-mentioned embodiments, while an example that the parameter value W based on the developer capacity (initial loading amount) is used was explained, the present invention is not limited to such an example, but, the parameter value can be based on the type of the developer and/or property of manufacturing lot of the cartridge influenced upon the manufacturing condition of the cartridge. Namely, the parameter value may be based on any factor influencing upon the property of the cartridge.

Further, in the above-mentioned embodiments, while an example that the resolving power of the developer remaining amount detection has the dividing interval of about 5% was explained, in the present invention, the developer remaining amount detection and the resolving power of the display are not limited to such an example, but may be independently set to match with the embodiments. Of course, the finer the interval, the finer developer remaining amount display can be made. Further, also regarding the resolving power of the developer remaining amount detection, not only the uniform interval may be adopted, but also the interval at the fewer remaining amount may be made narrower, such as 100%, 30%, 20%, 15%, 10%, 8%, 5%, . . .

Further, in the above-mentioned embodiments, while an example that the developer remaining amount detection correction table 24 is stored in the main body control portion 21 was explained, but, such a table may be stored in the storing means 20 of the cartridge. In this case, the cartridge itself can have the table corresponding to the property of the cartridge, with the result that the successive developer remaining amount detection can be effected more correctly in correspondence to various cartridges.

Further, in the above-mentioned embodiments, while an example that the increase/decrease relationship between the electrostatic capacity detected by the developer remaining amount detecting means and the detection voltage ultimately detected by the developer remaining amount detecting device is set to have a reverse relation was explained, the relationship between the electrostatic capacity and the voltage is varied with the detecting circuit provided in the image forming apparatus, and, thus, the relationship between the electrostatic capacity and the voltage may be the same decrease function or increase function.

The displaying style of the developer remaining amount is not limited to (g) or (%), but, other displaying style such as "last XXX sheets can be outputted" may be used. Further, regarding the display, it is not limited to a ratio to full (i.e., remaining %), but, for example, gas gauge, pole graph or value display may be used. Further, notification of the remaining amount based on alarm message or voice message may be used or the remaining amount may be recorded on a recording medium and be outputted, so long as the developer remaining amount can be informed to the operator.

Further, in the above-mentioned embodiments, while an example that the developer remaining amount is displayed on the display means 40 of the main body 100 of the apparatus was explained, the present invention is not limited to such an example, but, the developer remaining amount may be displayed on a picture plane (display) of an equipment such as a host computer connected to the main body 100 of the image forming apparatus for communication.

Further, in the above-mentioned embodiments, while an example that the developing roller 5 and first and second metal plates 31, 32 as plate antenna are provided was explained, the present invention is not limited to such an example, but, for example, it may be designed so that a single plate antenna is opposed to the developing roller 5 and change in electrostatic capacity between the developing roller 5 and the plate antenna caused when the developing bias is applied to the developing roller 5 is detected. Namely, by measuring the electrostatic capacity between at least one pair of electrodes, the developer amount can be detected and the cost can be reduced.

Further, in the above-mentioned embodiments, while an example that the plate antenna system is used as the developer remaining amount detecting means was explained, the present invention is not limited to be applied to only a cartridge having the developer remaining amount detecting means of such system. So long as the transition of the output signal of the developer remaining amount detecting means may be dispersed due to the assembling tolerance of the developer remaining amount detecting means, tolerances of other parts of the cartridge, a difference in initial loading amount, a difference in type of developer, a difference in manufacturing lot of developer to be loaded, tolerances of electronic parts of the main body of the image forming apparatus and/or property of manufacturing lot of the cartridge influenced upon the manufacturing condition of the cartridge, by applying the principle of the present invention without limitation of system, correct developer remaining amount detection can be achieved.

The present invention is not limited to the above-mentioned embodiments, and various alterations and modifications can be made within the scope of the invention.

What is claimed is:

1. An image forming apparatus comprising:

a developer container for containing developer;

detecting means for detecting an amount of the developer contained in said developer container; and determining means for determining a display level of a remaining amount of the developer, wherein at least said developer container is detachably mountable to a main body of an image forming apparatus as a unit, and wherein said determining means determines the display level on the basis of latest information of a detected amount of the developer and predetermined information relating to the remaining to the remaining amount of the developer upon generation of a white void image.

2. An image forming apparatus according to claim 1, further comprising a memory device for storing the predetermined information.

3. An image forming apparatus according to claim 2, wherein said memory device is mounted to said unit.

4. An image forming apparatus according to claim 1, wherein said detecting means is disposed within said developer container.

5. An image forming apparatus according to claim 1, wherein the predetermined information varies with an initial amount of the developer contained in said developer container.

6. An image forming apparatus according to claim 1, wherein the predetermined information varies with a configuration of said developer container.

7. An image forming apparatus according to claim 1, further comprising an agitating member for agitating the developer, wherein said agitating member is provided within said developer container, and the predetermined information varies in accordance with a parameter of said agitating member.

8. An image forming apparatus according to claim 7, wherein the parameter is at least one of a length, magnitude, and thickness of said agitating member.

9. An image forming apparatus according to claim 1, further comprising a display device, wherein the display level determined by said determining means is displayed by said display device.

10. An image forming apparatus according to claim 1, further comprising output means for outputting the display level determined by said determining means to an external equipment including a display device, wherein the display level is displayed by said display device.

11. An image forming apparatus according to claim 1, wherein said unit includes at least one of an image bearing member, developing means for supplying the developer to said image bearing member, and cleaning means for cleaning said image bearing member.

12. A unit detachably mountable on an image forming apparatus, comprising:

a memory; and a developer container for containing developer, wherein said memory stores predetermined information for use in calculation formula to determine a remaining amount of the developer corresponding to an output of a detecting means for detecting an amount of the developer contained in said developer container.

13. A unit according to claim 12, wherein said detecting means is disposed within said developer container.

14. A unit according to claim 12, wherein the predetermined information varies with an initial amount of the developer contained in said developer container.

15. A unit according to claim 12, wherein the predetermined information varies with a configuration of said developer container.

16. A unit according to claim 12, further comprising an agitating member for agitating the developer, wherein said agitating member is provided within said developer container, and wherein the predetermined information varies with a parameter of said agitating member.

17. A unit according to claim 16, wherein the parameter is at least one of a length, magnitude, and thickness of said agitating member.

18. A unit according to claim 12, further comprising at least one of an image bearing member, developing means for supplying the developer to said image bearing member, and cleaning means for cleaning said image bearing member.

19. An image forming apparatus according to claim 12, wherein the predetermined information relates to a remaining amount of developer contained in said developer container upon generation of a white void image.

20. A unit according to claim 12, wherein said memory comprises initial rewritable information corresponding to an output from the detecting means at a time when the developer is not substantially consumed, the rewritable information being revised during a period in which an output value from the detecting means is substantially constant in spite of the developer being consumed.

21. A unit according to claim 20, wherein the rewritable information is revised to information corresponding to an output from the detecting means at a time when an output from the detecting means indicates an increase of an amount of the developer in said container.

22. A unit according to claim 20, wherein the rewritable information is used in the calculation formula.

23. A developer remaining amount displaying system comprising:

a first unit, which is detachably mountable to a main body of an image forming apparatus and in which an amount of developer is loaded;

a second unit, which is detachably mountable to said main body of said image forming apparatus and in which an amount of developer is loaded, the amount of developer loaded in said second unit being more than the amount of the developer loaded in said first unit, and which can be mounted to said main body of said image forming apparatus in place of said first unit; and a display for displaying a remaining amount of the developer, wherein when said second unit is mounted on said main body of said image forming apparatus, said display displays information that there is no remaining amount of the developer or information that said first unit should be changed at a stage that a detection remaining amount of developer remaining amount detecting means is greater than said first unit is mounted.

24. A developer remaining amount displaying system comprising:

a first unit, which is detachably mountable to a main body of an image forming apparatus and in which developer is loaded and which includes an agitating sheet for agitating the developer;

a second unit, which is detachably mountable to said main body of said image forming apparatus and which includes an agitating sheet having a longer free length than a free length of said agitating sheet of said first unit and which can be mounted to said main body of said image forming apparatus in place of said first unit; and a display for displaying a remaining amount of the developer, wherein when said second unit is mounted to said main body of said image forming apparatus, said display displays information that there is no remaining amount of the developer or information that said first unit should be changed at a stage that a detection remaining amount of developer remaining amount detecting means is greater than an amount of developer when said first unit is mounted.

25. An image forming apparatus, comprising:

a developer container for containing developer;

developer amount detecting means for detecting an amount of the developer contained in said developer container;

a memory device for storing predetermined information; and determining means for determining a remaining amount of the developer contained in said developer container, wherein at least said developer container and said memory device are detachably mountable to a main body of said image forming apparatus as a unit, and wherein said determining means determines the remaining amount of the developer by making a comparison between a latest amount of the developer detected by said developer amount detecting means and a comparison value calculated by assigning the predetermined information to a calculation formula to determine the remaining amount of the developer.

26. An image forming apparatus according to claim 25, wherein said image forming apparatus stores a table in which correction values for changing the comparison value correspond to a plurality of remaining amounts of the developer determined by said determining means.

27. An image forming apparatus according to claim 25, wherein the predetermined information relates to said unit.

28. An image forming apparatus according to claim 25, wherein the predetermined information relates to the remaining amount of the developer upon generation of a white void image.

29. A memory device mounted to a cartridge detachably mountable to an image forming apparatus and including a developer container, said memory device comprising:

predetermined information to be used in a calculation formula to determine a remaining amount of developer contained in the developer container corresponding to a latest an output of a detecting means for detecting an amount of developer in the developer container.

30. A memory device according to claim 29, wherein a value obtained by the calculation formula is a comparison value for comparison with the latest output from the detecting means to determine the remaining amount of the developer.

31. A memory device according to claim 30, wherein the comparison value is variable.

32. A memory device according to claim 29, wherein the predetermined information relates to the remaining amount of the developer upon generation of a white void image.

33. A memory device according to claim 29, wherein said memory device is connected to a transmitting device to transmit the predetermined information to the image forming apparatus.

34. A memory device according to claim 29, further comprising a memory area for storing the remaining amount of developer determined by determining means.

35. A memory device according to claim 29, wherein said memory device comprises initial rewritable information corresponding to an output from the detecting means at a time when the developer is not substantially consumed, wherein the rewritable information is revised during a period in which an output from the detecting means is substantially constant in spite of the developer being consumed.

36. A memory device according to claim 35, wherein the rewritable information is revised to information corresponding to an output from the detecting means at a time when an output from the detecting means includes an increase of an amount of the developer in said container.

37. A unit according to claim 35, wherein the rewritable information is used in the calculation formula.

38. A developer remaining amount determining method for determining a remaining amount of developer contained in a cartridge detachably mountable to an image forming apparatus, said method comprising the steps of:

detecting an amount of the developer contained in the cartridge;

effecting a calculation of a comparison value by assigning a predetermined information relating to the cartridge and a correction value to a calculation formula to determine the remaining amount of the developer; and changing the correction value until a relationship between a detected amount of the developer detected in said step of detecting an amount of the developer and the comparison value satisfies a predetermined relationship.

39. A developer remaining amount determining method according to claim 38, further comprising a step of reading the predetermined information from the cartridge prior to said step of effecting a calculation of the comparison value.

40. A developer remaining amount determining method for determining a remaining amount of developer contained in a cartridge including a memory device detachably mountable to an image forming apparatus, said method comprising the steps of:

detecting an amount of the developer contained in the cartridge as a latest amount of the developer;

effecting a calculation of a comparison value by assigning a predetermined information relating to the cartridge stored in the memory device, a correction value stored in the image forming apparatus and a rewritable information into a calculation formula to determine the remaining amount of the developer, the rewritable information corresponding to an output from the detecting means at a time when the developer is not substantially consumed, the rewritable information being revised during a period in which an output value from the detecting means is substantially constant in spite of the developer being consumed; and changing the correction value until a relationship between the latest amount of the developer detected in said step of detecting an amount of the developer and the comparison value satisfies a predetermined relationship.

41. A developer remaining amount determining method according to claim 40, further comprising a step of reading the predetermined information and the rewritable information from the memory device prior to said step of effecting a calculation of the comparison value.

42. A memory device mounted to a cartridge detachably mountable to an image forming apparatus and having a developer container, said memory device comprising:

at least two pieces of information sent to a control part of the image forming apparatus, wherein said two pieces of information are a W value and a PAF value, which are parameters of a formula to determine a comparison value F defined by $F=Z((\alpha-1)PAF+W)+PAF$, wherein Z is a correction value, which is successively introduced until a remaining amount of developer is determined and $\alpha$ is constant, wherein the comparison value F is used for comparison with the latest output from a detecting means in order to determine the remaining amount of developer contained in the developer container corresponding to the latest output from the detecting means for detecting an amount of developer in the developer container.

43. A memory device according to claim 42, wherein the PAF value is information that can be revisable according to an order from the control part of the image forming apparatus.

44. A memory device according to claim 42, further comprising a storage area for further storing the determined remaining amount of developer.

* * * * *

UNITED STATES PATENT AND TRADEMARK OFFICE

CERTIFICATE OF CORRECTION

PATENT NO. : 6,775,487 B2
DATED : August 10, 2004
INVENTOR(S) : Tomomi Kakeshita It is certified that error appears in the above-identified patent and that said Letters Patent is hereby corrected as shown below:

Column 1,
Line 45, “be” should read -- been --.

Column 12,
Line 26, “constant,” should read -- constants, --.

Column 13,
Line 22, “values:” should read -- value: --; and
Line 56, “Image” should read -- image --.

Column 14,
Lines 5 and 17, “F (PM,” should read -- F (PAF, --;
Lines 6 and 18, “judges” should read -- judged --; and “F (PM,” should read -- F (PAF, --;
Line 9, “if” should read -- is --;
Lines 34 and 46, “judges” should read -- judged --; and
Line 47, “NO.” should read -- NO, --.

Column 16,
Line 63, “PAPF” should read -- PAF --.

Column 17,
Line 29, “constant,” should read -- constants, --.

Column 18,
Line 28, “if” should read -- is --;
Line 36, “(2)is” should read -- (2) is --;
Line 64, “o” should read -- of --; and
Line 66, “judges” should read -- judged --.

Column 19,
Lines 11 and 27, ‘judges” should read -- judged --; and
Line 39, “judges” should read -- judged --; and “S218;” should read -- S218: --.

Column 20,
Line 59, “upon” should read -- when --; and
Line 64, “thus” should read -- this --.

Column 21,
Line 16, “constant,” should read -- constants, --; and
Line 46, “satisfied he” should read -- staisfies the --.

UNITED STATES PATENT AND TRADEMARK OFFICE

CERTIFICATE OF CORRECTION

PATENT NO. : 6,775,487 B2
DATED : August 10, 2004
INVENTOR(S) : Tomomi Kakeshita It is certified that error appears in the above-identified patent and that said Letters Patent is hereby corrected as shown below:

Column 22,
Lines 14, 30 and 42, “judges” should read -- judged --.

Column 23,
Line 27, “5%,” should read -- 5%, ····. --.

Column 24,
Line 6, “illustrated” should read -- illustrated embodiment --.

Column 25,
Line 48, “S223.” should read -- S223). --.

Column 26,
Lines 4, 16, 31 and 43, “judges” should read -- judged --;
Line 27, “till” should read -- until --; and
Line 34, “Interior” should read -- interior --.

Column 27,
Line 12, “5%, ··· the” should read -- 5% ···. The --.

Column 29,
Line 42, “an” should read -- the --; and
Line 48, “to the remaining” (second occurrence) should be deleted.

Column 30,
Line 28, “in” should read -- in a --.

Column 31,
Line 19, “on” should read -- to --.

UNITED STATES PATENT AND TRADEMARK OFFICE

CERTIFICATE OF CORRECTION

PATENT NO. : 6,775,487 B2
DATED : August 10, 2004
INVENTOR(S) : Tomomi Kakeshita It is certified that error appears in the above-identified patent and that said Letters Patent is hereby corrected as shown below:

Column 32,
Line 18, "an" (first occurrence) should be deleted.

Signed and Sealed this

Twenty-sixth Day of October, 2004

JON W. DUDAS
*Director of the United States Patent and Trademark Office*